US009478405B2

(12) United States Patent
Coon et al.

(10) Patent No.: US 9,478,405 B2
(45) Date of Patent: Oct. 25, 2016

(54) METHOD TO PERFORM BEAM-TYPE COLLISION-ACTIVATED DISSOCIATION IN THE PRE-EXISTING ION INJECTION PATHWAY OF A MASS SPECTROMETER

(71) Applicant: Wisconsin Alumni Research Foundation, Madison, WI (US)

(72) Inventors: Joshua J. Coon, Middleton, WI (US); Graeme C. McAlister, Madison, WI (US)

(73) Assignee: Wisconsin Alumni Research Foundation, Madison, WI (US)

( * ) Notice: Subject to any disclaimer, the term of this patent is extended or adjusted under 35 U.S.C. 154(b) by 0 days.

(21) Appl. No.: 14/703,643

(22) Filed: May 4, 2015

(65) Prior Publication Data

US 2016/0020081 A1 Jan. 21, 2016

Related U.S. Application Data

(63) Continuation of application No. 14/198,067, filed on Mar. 5, 2014, now Pat. No. 9,053,916, which is a continuation of application No. 13/234,398, filed on Sep. 16, 2011, now Pat. No. 8,742,333.

(60) Provisional application No. 61/383,837, filed on Sep. 17, 2010.

(51) Int. Cl.

| | |
|---|---|
| ***H01J 49/26*** | (2006.01) |
| ***H01J 49/10*** | (2006.01) |
| ***H01J 49/00*** | (2006.01) |

(52) U.S. Cl.

CPC ..... *H01J 49/10* (2013.01); *H01J 49/004* (2013.01); *H01J 49/0045* (2013.01)

(58) Field of Classification Search

USPC ..... 250/281–283, 287, 288, 290, 293

See application file for complete search history.

(56) References Cited

U.S. PATENT DOCUMENTS

| | | | |
|---|---|---|---|
| 4,060,823 | A | 11/1977 | Howorth et al. |
| 4,303,930 | A | 12/1981 | Van Gorkom et al. |

(Continued)

FOREIGN PATENT DOCUMENTS

| | | |
|---|---|---|
| DE | 199 61 811 | 7/2001 |
| WO | 96/04676 | 2/1996 |

(Continued)

OTHER PUBLICATIONS

Bantscheff et al. (2008) "Robust and Sensitive iTRAQ Quantification on an LTQ Orbitrap Mass Spectrometer," Molecular & Cellular Proteomics 7.9:1702-1713.

(Continued)

*Primary Examiner* — Bernard Souw
(74) *Attorney, Agent, or Firm* — Lathrop & Gage LLP

(57) ABSTRACT

Described herein are methods and systems related to the use of the pre-existing ion injection pathway of a mass spectrometer to perform beam-type collision-activated dissociation, as well as other dissociation methods. The methods can be practiced using a wide range of mass spectrometer configurations and allows $MS^n$ experiments to be performed on very basic mass spectrometers, even those without secondary mass analyzers and/or collision cells. Following injection and selection of a particular ion type or population, that population can be fragmented via beam-type collision-activated dissociation (CAD), as well as other dissociation methods, using the pre-existing ion injection pathway or inlet of a mass spectrometer. For CAD applications, this is achieved by transmitting the ions back along the ion injection pathway with a high degree of kinetic energy. As the ions pass into the higher pressure regions located in or near the atmospheric pressure inlet, the ions are fragmented and then trapped. Following fragmentation and trapping, the ions can either be re-injected into the primary ion selection device or sent on to a secondary mass analyzer.

20 Claims, 28 Drawing Sheets

(56) References Cited

U.S. PATENT DOCUMENTS

| | | | | |
|---|---|---|---|---|
| 5,138,402 | A | 8/1992 | Tsukamoto et al. | |
| 5,179,278 | A | 1/1993 | Douglas | |
| 5,814,832 | A | 9/1998 | Takeda et al. | |
| 5,994,694 | A | 11/1999 | Frank et al. | |
| 6,011,259 | A | 1/2000 | Whitehouse et al. | |
| 6,177,668 | B1 | 1/2001 | Hager | |
| 6,570,153 | B1 | 5/2003 | Li et al. | |
| 6,586,727 | B2 | 7/2003 | Bateman et al. | |
| 6,670,194 | B1 | 12/2003 | Aebersold et al. | |
| 6,722,200 | B2 | 4/2004 | Roukes et al. | |
| 6,734,087 | B2 | 5/2004 | Hidaka et al. | |
| 6,753,523 | B1 | 6/2004 | Whitehouse et al. | |
| 6,838,663 | B2 | 1/2005 | Coon et al. | |
| 6,878,933 | B1 | 4/2005 | Coon | |
| 6,940,065 | B2 | 9/2005 | Graber et al. | |
| 7,145,133 | B2 | 12/2006 | Thomson | |
| 7,195,751 | B2 | 3/2007 | Pappin et al. | |
| 7,297,939 | B2 | 11/2007 | Bateman et al. | |
| 7,388,201 | B2 | 6/2008 | Cholewa et al. | |
| 7,408,147 | B2 | 8/2008 | Blick et al. | |
| 7,534,622 | B2 | 5/2009 | Hunt et al. | |
| 7,544,931 | B2 * | 6/2009 | Yamaguchi | H01J 49/0027 250/281 |
| 7,554,931 | B2 * | 6/2009 | Zhou | H04L 29/12028 370/254 |
| 7,558,682 | B2 | 7/2009 | Yamamoto | |
| 7,884,324 | B2 | 2/2011 | Blick et al. | |
| 7,982,070 | B2 | 7/2011 | Smith et al. | |
| 8,274,059 | B2 | 9/2012 | Blick | |
| 8,278,115 | B2 | 10/2012 | Coon et al. | |
| 8,742,333 | B2 * | 6/2014 | Coon | H01J 49/004 250/282 |
| 9,053,916 | B2 * | 6/2015 | Coon | H01J 49/004 |
| 2002/0019056 | A1 | 2/2002 | Shushan et al. | |
| 2002/0166962 | A1 | 11/2002 | Roukes et al. | |
| 2002/0195555 | A1 | 12/2002 | Weinberger et al. | |
| 2003/0139885 | A1 | 7/2003 | Brock et al. | |
| 2005/0009053 | A1 | 1/2005 | Boecker et al. | |
| 2005/0063864 | A1 | 3/2005 | Sano et al. | |
| 2005/0074816 | A1 | 4/2005 | Duncan et al. | |
| 2005/0147982 | A1 | 7/2005 | Pappin et al. | |
| 2005/0148087 | A1 | 7/2005 | Pappin et al. | |
| 2005/0153456 | A1 | 7/2005 | Pappin | |
| 2006/0105416 | A1 | 5/2006 | Pappin et al. | |
| 2006/0115871 | A1 | 6/2006 | Bruce et al. | |
| 2006/0172319 | A1 | 8/2006 | Yan et al. | |
| 2006/0214257 | A1 | 9/2006 | Ninomiya et al. | |
| 2006/0243900 | A1 | 11/2006 | Overney et al. | |
| 2007/0023621 | A1 | 2/2007 | Blick et al. | |
| 2007/0054345 | A1 | 3/2007 | Hunter | |
| 2007/0207555 | A1 | 9/2007 | Guerra et al. | |
| 2007/0218560 | A1 | 9/2007 | Pillai et al. | |
| 2008/0029697 | A1 | 2/2008 | Willis et al. | |
| 2008/0070314 | A1 | 3/2008 | Geromanos et al. | |
| 2008/0113441 | A1 | 5/2008 | Orlando et al. | |
| 2008/0121793 | A1 * | 5/2008 | Yamaguchi | H01J 49/0081 250/282 |
| 2008/0149825 | A1 | 6/2008 | Kozlovski et al. | |
| 2008/0164409 | A1 | 7/2008 | Schultz et al. | |
| 2008/0206737 | A1 | 8/2008 | Hunter | |
| 2008/0271778 | A1 | 11/2008 | Defries et al. | |
| 2008/0272292 | A1 | 11/2008 | Geromanos et al. | |
| 2009/0065686 | A1 | 3/2009 | Shilov et al. | |
| 2009/0072132 | A1 | 3/2009 | Manri et al. | |
| 2009/0092862 | A1 | 4/2009 | Morris et al. | |
| 2009/0194682 | A1 | 8/2009 | Zhang et al. | |
| 2009/0283673 | A1 | 11/2009 | Shilov et al. | |
| 2009/0309015 | A1 | 12/2009 | Schultz et al. | |
| 2009/0321633 | A1 | 12/2009 | Blick et al. | |
| 2010/0096542 | A1 | 4/2010 | Whitehouse et al. | |
| 2010/0320372 | A1 | 12/2010 | Blick | |
| 2010/0330680 | A1 | 12/2010 | Frey et al. | |
| 2011/0297823 | A1 | 12/2011 | Coon et al. | |
| 2012/0022230 | A1 | 1/2012 | Smith et al. | |
| 2012/0091330 | A1 * | 4/2012 | Coon | H01J 49/004 250/282 |
| 2012/0223223 | A1 | 9/2012 | Sugiyama et al. | |
| 2012/0261568 | A1 | 10/2012 | Coon et al. | |
| 2016/0020081 | A1 * | 1/2016 | Coon | H01J 49/004 250/282 |

FOREIGN PATENT DOCUMENTS

| | | |
|---|---|---|
| WO | 97/48120 | 12/1997 |
| WO | 02/12443 | 2/2002 |
| WO | 03/095616 | 11/2003 |
| WO | 03/095617 | 11/2003 |
| WO | 2004/041998 | 5/2004 |
| WO | 2007/016113 | 2/2007 |
| WO | 2007/094817 | 8/2007 |

OTHER PUBLICATIONS

Cox et al. (1996) "Role of the Site of Protonation in the Low-Energy Decompositions of Gas-Phase Peptide Ions," J Am Soc Mass Spectrom 7:522-531.

De Godoy et al. (Oct. 30, 2008) "Comprehensive Mass-Spectrometry-Based Proteome Quantification of Haploid Versus Diploid Yeast," Nature 455:1251-1255.

Domon et al. (Apr. 14, 2006) "Mass Spectrometry and protein Analysis," Science 312:212-217, downloaded Jun. 1, 2012.

Dongre et al. (1996) "Influence of Peptide Composition, Gas-Phase Basicity, and Chemical Modification on Fragmentation Efficiency: Evidence for the Mobile Proton Model," J Am Chem Soc 118:8365-8374.

Falick et al. (1993) "Low-Mass Ions Produced from Peptides by High-Energy Collision-Induced Dissociation in Tandem Mass Spectrometry," J Am Soc Mass Spectrom 4:882-893.

Geer et al. (2004) "Open Mass Spectrometry Search Algorithm," Journal of Proteome Research 3:958-964.

Gerber et al. (Jun. 10, 2003) "Absolute Quantification of Proteins and Phosphoproteins from Cell Lysates by Tandem MS," PNAS 100(12):6940-6945.

Gorshkov et al. (1997) "A Dual-Trap Design and Its Applications in Electrospray Ionization FTICR Mass Spectrometry," Anal Chem 69:1307-1314.

Haller et al. (1996) "Collision Induced Decomposition of Peptides. Choice of Collision Parameters," J Am Soc Mass Spectrom 7:677-681.

Hunt et al. (1981) "Sequence-Analysis of Polypeptides by Collision Activated Dissociation on a Triply Quadrupole Mass Spectrometer," Biomedical Mass Spectrometry 8(9):397-408.

Huttlin et al. (Dec. 23, 2010) "A Tissue-Specific Atlas of Mouse Protein Phosphorylation and Expression," Cell 143:1174-1189.

Kersey et al. (2004) "The International Protein Index: An Integrated Database for Proteomics Experiments," Proteomics 4:1985-1988.

Ludwig et al. (2006) "Derivation of Human Embryonic Stem Cells in Defined Conditions," Nature Biotechnology 24(2):185-187.

Makarov et al. (2006) "Performance Evaluation of a Hybrid Linear Ion Trap/Orbitrap Mass Spectrometer," Analytical Chemistry 78:2113-2120.

McAlister et al. (2010) "Analysis of Tandem Mass Spectra by FTMS for Improved Large-Scale Proteomics with Superior Protein Quantification," Analytical Chemistry 82:316-322.

Nagaraj et al. (2010) "Feasibility of Large-Scale Phosphoproteomics with Higher Energy Collisional Dissociation Fragmentation," Journal of Proteome Research 9:6786-6794.

Nesvizhskii et al. (2005) "Interpretation of Shotgun Proteomic Data: The Protein Inference Problem," Mol Cell Proteomics 4.10:1419-1440.

Neta et al. (2009) "Collisional Energy Dependence of Peptide Ion Fragmentation," J Am Soc Mass Spectrom 20:469-476.

Olsen et al. (Sep. 2007) "Higher-Energy C-Trap Dissociation for Peptide Modification Analysis," Nature Methods 4(9):709-712.

Olsen et al. (2009) "A Dual Pressure Linear Ion Trap Orbitrap Instrument with Very High Sequencing Speed," Molecular & Cellular Proteomics 8.12:2759-2769.

(56) References Cited

OTHER PUBLICATIONS

Phanstiel et al. (2008) "Peptide and Protein Quantification Using iTRAQ with Electron Transfer Dissociation," J Am Soc Mass Spectrom 19:1255-1262.
Picotti et al. (Jan. 2010) "High-Throughput Generation of Selected Reaction-Monitoring Assays for Proteins and Proteomes," Nature Methods 7(1):43-46 and suppl pages.
Ross et al. (2004) "Multiplexed Protein Quantitation in *Saccharomyces cerevisiae* Using Amine-Reactive Isobaric Tagging Reagents," Molecular & Cellular Proteomics 3.12:1154-1169.
Schwartz et al. (2002) "A Two-Dimensional Quadrupole Ion Trap Mass Spectrometer," J Am Soc Mass Spectrom 13:659-669.
Summerfield et al. (1997) "Fragmentation Efficiencies of Peptide Ions Following Low Energy Collisional Activation," International J Mass Spectrom and Ion Processes 165:509-521.
Syka et al. (2004) "Novel Linear Quadrupole Ion Trap/FT Mass Spectrometer: Performance Characterization and Use in the Comparative Analysis of Histone H3 Post-Translational Modifications," Journal of Proteome Research 3(3):621-626.
Thompson et al. (2003) "Tandem Mass Tags: A Novel Quantification Strategy for Comparative Analysis of Complex Protein Mixtures by MS/MS," Analytical Chemistry 75(8):1895-1904.
Wenger et al. (2011) "Compass: a Suite of Pre- and Post-Search Proteomics Software Tools for OMSSA," Proteomics 11(6):1064-1074.
Wysocki et al. (2000) "Special Feature: Commentary—Mobile and Localized Protons: a Framework for Understanding Peptide Dissociation," J Mass Spectrom 35:1399-1406.
Zhang et al. (2009) "Optimized Orbitrap HCD for Quantitative Analysis of Phosphopeptides," J Am Soc Mass Spectrom 20:1425-1434.

* cited by examiner (a)

(b)

METHOD TO PERFORM BEAM-TYPE COLLISION-ACTIVATED DISSOCIATION IN THE PRE-EXISTING ION INJECTION PATHWAY OF A MASS SPECTROMETER

CROSS-REFERENCE TO RELATED APPLICATIONS

This application claims the benefit of and priority under 35 U.S.C. 119(e) to U.S. application Ser. No. 14/198,067, filed Mar. 5, 2014, U.S. application Ser. No. 13/234,398, filed Sep. 16, 2011 (now U.S. Pat. No. 8,742,333, issued Jun. 3, 2014), and U.S. Provisional Application No. 61/383,837, filed Sep. 17, 2010, entitled "Method to Perform Beam-Type Collision-Activated Dissociation in the Pre-Existing Ion Injection Pathway of a Mass Spectrometer", all of which are hereby incorporated by reference in their entirety.

STATEMENT REGARDING FEDERALLY SPONSORED RESEARCH OR DEVELOPMENT

This invention was made with government support under GM080148 awarded by the National Institutes of Health. The government has certain rights in the invention.

BACKGROUND

The ability to identify proteins and determine their chemical structures has become central to the life sciences. The amino acid sequence of proteins provides a link between proteins and their coding genes via the genetic code, and, in principle, a link between cell physiology and genetics. The identification of proteins provides a window into complex cellular regulatory networks.

Ion trap mass spectrometers are among the most widely used platforms for molecular analysis—spanning natural products, to pharmaceuticals, to biologics such as proteins. Most mass spectrometer-based experiments begin with the isolation of a group of compounds from a set of samples through some sort of extraction technique, e.g., proteins from tissues, cell lysates, or fluids followed by proteolytic digestion of those proteins into peptides (i.e., bottom-up proteomics). Frequently, but not necessarily, the mass spectrometers are then coupled with some form of separations, e.g., electrophoretic or chromatographic. Over the course of just a few hours, mass spectral instruments can autonomously interrogate tens of thousands of molecular species via tandem mass spectrometry.

Although some of the initial descriptions of low-energy collision activated dissociation tandem mass spectrometric analysis were performed using beam-type dissociation on triple quadrupole mass spectrometers, due to the speed and sensitivity of quadrupolar ion trap analyzers, resonant-excitation collision activated dissociation is arguably the most widely used dissociation method for many common types of analyses (e.g., bottom-up proteomics, glycomics, etc.). Recently though, there has been a surge in interest in beam-type collision activated dissociation—particularly its application towards the interrogation of precursors that are typically not amenable to resonant excitation collision activated dissociation (e.g., phosphorylated peptides, metabolites, etc.).

Developed in parallel with these rising interests, hybrid instruments that possess multiple analyzers and multiple means of peptide fragmentation—including beam-type collision activated dissociation—have become common place (e.g., the LTQ-Orbitrap, and the Velos-Orbitrap). One common element to all of these instruments that are capable of beam-type collision activated dissociation is that they have dedicated collision cells for conducting the fragmentation technique. The price for enabling beam-type collision activated dissociation on these instruments, therefore, is increasing instrument complexity and cost.

The characteristics and performance of commonly used types of mass spectrometers are presented in Table B1. Check marks indicate available, check marks in parentheses indicate optional. Pluses indicate possible or moderate (+), good or high (++), and excellent or very high (+++), respectively. Seq., sequential.

TABLE B1

Characteristics and Performance of Commonly Used Types of Mass Spectrometers*

| | IT-LIT[1] | Q-Q-ToF[2] | ToF-ToF[3] | FT-ICR[4] | Q-Q-Q[5] | QQ-LIT[6] |
|---|---|---|---|---|---|---|
| Mass accuracy | Low | Good | Good | Excellent | Medium | Medium |
| Resolving power | Low | Good | High | Very high | Low | Low |
| Sensitivity (LOD) | Good | | High | Medium | High | High |
| Dynamic range | Low | Medium | Medium | Medium | High | High |
| ESI[7] | ✓ | ✓ | | ✓ | ✓ | ✓ |
| MALDI[8] | (✓) | (✓) | ✓ | | | |
| MS/MS capabilities | ✓ | ✓ | ✓ | ✓ | ✓ | ✓ |
| Additional capabilities | Seq. MS/MS | | | Precursor, Neutral loss, MRM | Precursor, Neutral loss, MRM | Precursor, Neutral loss, MRM[9] |
| Identification | ++ | ++ | ++ | +++ | + | + |
| Quantification | + | +++ | ++ | ++ | +++ | +++ |

TABLE B1-continued

Characteristics and Performance of Commonly Used Types of Mass Spectrometers*

| | IT-LIT[1] | Q-Q-ToF[2] | ToF-ToF[3] | FT-ICR[4] | Q-Q-Q[5] | QQ-LIT[6] |
|---|---|---|---|---|---|---|
| Throughput | +++ | ++ | +++ | ++ | ++ | ++ |
| Detection of modifications | + | + | + | + | | +++ |

*Table adapted from Domon and Aebersold, *Science* 14 Apr. 2006: Vol. 312. no. 5771, pp. 212-217
[1]Ion Trap-Linear Ion Trap,
[2]Quadruple-Quadruple-Time of Flight,
[3]Time of Flight-Time of Flight,
[4]Fourier Transform-Ion Cyclotron Resonance,
[5]Quadruple-Quadruple-Quadruple,
[6]Quadruple-Quadruple-Linear Ion Trap,
[7]Electrospray Ionization,
[8]Matrix Assisted Laser Desorption/Ionization,
[9]Multiple Reaction Monitoring As can be seen from Table B1, a multitude of different mass-spectral techniques and instrumentation have been developed over the years. Many mass-spectral instruments have been designed to carry out one type of mass-spectral analysis without the ability to carry out other types or are very limited in their scope of application. This has led to instruments of increasing complexity designed to carry out increasingly complex mass-spectral analysis. The increasing complexity of instruments designed to carry out $MS^n$ analysis, for example, has led to increasing costs for such instruments. These instruments add a separate mass selection region for each additional MS step, which increases the cost and complexity with each added MS step capability. A need, therefore, exists in the art for the ability to perform $MS^n$ experiments without the need to increase the complexity and cost of traditional MS or MS/MS instruments.

SUMMARY

As an alternative to relying on instruments of increasing complexity and cost, the present methods and devices enable beam-type collision activated dissociation, as well as other dissociation methods, on a range of pre-existing instruments without requiring any hardware modifications. With most conventional mass spectrometers a stream of ions is transmitted from an atmospheric pressure inlet to an ion selection/analysis device using a collection of RF devices, tubes and lenses. These ion optics elements pass through differentially pumped regions as they connect the atmospheric pressure inlet to the ion selection/analysis device. Following injection and selection of a particular ion type or ion population, those ions can be fragmented via beam-type collision activated dissociation, as well as other dissociation methods, using the inlet and/or pre-existing ion injection pathway of the mass spectrometer. For beam-type collision activated dissociation, for example, this may be achieved by transmitting the ions back along the ion injection pathway with a high degree of kinetic energy. As the ions pass into the higher pressure regions located in and near the atmospheric pressure inlet, the ions are fragmented and then trapped. Following activation/fragmentation and trapping, the ions can either be re-injected into the primary ion selection device or sent on to a secondary mass analyzer.

The fragmentation technique described herein is particularly well suited for the interrogation of precursors that generate low mass-to-charge product ions relative to the precursor mass-to-charge ratio. Typically, when these types of precursors are fragmented by resonant excitation collision activated dissociation, the resulting low mass-to-charge product ions fall beneath the low-mass cutoff of that fragmentation technique. The methods and devices for beam-type collision activated dissociation described herein are in general indifferent to the RF amplitude of the ion optics. Hence, this technique can fragment ions at RF amplitudes that allow for a dramatically lower low-mass cutoff, which in turn allows retention of any low mass-to-charge fragments. For example, peptides labeled with isobaric tags for relative quantitation (e.g., iTRAQ and TMT) can possess large precursor mass-to-charge ratios (>1000 m/z), yet the quantitative reporter ions have quite low m/z ratios (<150 m/z). During a typical resonant excitation collision activated dissociation experiment these lighter reporter ions would not be detected because they would fall beneath the low-mass cutoff enforced by the fragmentation technique. Using the devices and methods described herein, however, their formation and detection is quite feasible.

Accordingly, described herein are methods and devices related to the use of the pre-existing ion injection pathway and/or inlet of a mass spectrometer to perform beam-type collision-activated dissociation, as well as other dissociation methods. The methods can be practiced using a wide range of mass spectrometer configurations and allow $MS^n$ experiments to be performed on very basic mass spectrometers, even those without secondary mass analyzers and/or collision cells. Following injection and selection of a particular ion type or population, that population can be fragmented via beam-type collision-activated dissociation (CAD), as well as other dissociation methods, using the pre-existing ion injection pathway and/or inlet of a mass spectrometer. For beam-type collision activated dissociation, for example, this is achieved by transmitting the ions back along the ion injection pathway with a high degree of kinetic energy. As the ions pass into the higher pressure regions located in and near the atmospheric pressure inlet, the ions are fragmented and then trapped. Following activation and trapping, the ions can either be re-injected into the primary ion selection device or sent on to a secondary mass analyzer.

In an embodiment a method is provided for generating product ions, the method comprising: providing ions from an ion source through an inlet into an ion injection pathway having ion injection pathway ion optics; transmitting the ions along a first direction away from the inlet through the ion injection pathway into an ion selection device having ion selection device ion optics; selecting a subset of the ions in the ion selection device; wherein the subset of the ions have a preselected range of mass-to-charge ratios; and transmitting the subset of the ions having the preselected range of mass-to-charge ratios along a second direction toward the inlet through the ion injection pathway; wherein the ion injection pathway ion optics have an RF voltage component and a DC voltage component which are under independent control with respect to the ion selection device ion optics; wherein the subset of the ions transmitted along the second direction interact with one or more gases at a pressure greater than 0.01 Torr in the inlet or ion injection pathway and undergo dissociation, thereby fragmenting at least a portion of the subset of the ions having the preselected range of mass-to-charge ratios to generate the product ions. In an embodiment, for example, the subset of the ions transmitted along the second direction interact with one or more gases at a pressure greater than 0.01 Torr in the inlet or ion injection pathway and undergo dissociation as a result of the interaction with the one or more gases at a pressure greater than 0.01 Torr in the inlet or ion injection pathway.

The methods described herein can be carried out on many different mass spectrometer systems. In an embodiment, for example, a series of differentially pumped vacuum chambers are provided between the atmospheric pressure inlet and the mass selector and/or mass analyzer. Each differentially pumped vacuum chamber can be defined by its own vacuum manifold. Bridging the gap between an atmospheric pressure inlet and the mass selector and/or mass analyzer, and spanning the breadth of these differentially pumped vacuum chambers, is an ion injection pathway, which can comprise a set of ion optics that includes, but is not limited to, multipole ion guides and ion lenses.

The lenses included in the ion injection pathway are important and provide two distinct advantages with respect to systems which do not incorporate ion lenses into the ion injection pathway: First, the ion lenses improve ion transmission between adjacent multipoles by establishing focal points for ions passing through the lenses and multipoles. Second, the ion lenses may comprise apertures. By locating lenses having small apertures in vacuum manifold walls that separate the differentially pumped vacuum chambers, the ion lenses help lower gas conductance between adjacent chambers while permitting ions to be transmitted between adjacent chambers. This helps to create discrete pressure ranges in each of the differentially pumped vacuum chambers. Higher pressure chambers, for example greater than about 10 mTorr, are located toward the inlet side; and lower pressure chambers, for example less than about $10^{-4}$ Torr, are located near the analyzer. These discrete pressure chambers play a significant role in fragmentation of the ions. For example, discrete pressure chambers play a significant role in beam-type collisionally activated dissociation (CAD) fragmentation of the ions. Multipole devices closer to the isolation/analyzer device are typically housed in lower pressure chambers, for example less than about $10^{-4}$ Torr, so that selected precursor ions can be easily accelerated through these multipoles with moderate potential gradients, for example greater than about 10 eV, so that when the ions arrive into the higher pressure multipole devices upstream they have sufficient kinetic energy to induce beam-type collision activation. Access to different pressure ranges is also useful for realizing other forms of fragmentation in the ion injection pathway, for example IR photon-based activation may be more efficient when ions are trapped in a lower pressure chamber and certain ion/ion reaction rates may be faster when the ions are trapped at higher pressures.

Other ion lens device attributes are useful for the methods and devices described herein. The ion lens devices can be used to trap the ions in a multipole device where fragments are produced. In an embodiment, for example, a DC offset of an ion lens device is set higher, relative to the ion polarity, than the offset of a trapping multipole device. The ion lens devices also help to limit capacitive coupling between adjacent multipole devices, for example, by limiting capacitive coupling of a RF electric fields created by adjacent multipole devices so as to not interfere with adjacent multipole devices. This reduction in capacitive coupling is reduced, at least in part, because the multipole electric fields are shielded by ion lens devices located between, or at the ends of, the multipole devices.

In an embodiment a method is provided for generating product ions, the method comprising: providing ions from an ion source through an inlet into an ion injection pathway having ion injection pathway ion optics; transmitting the ions along a first direction away from the inlet through the ion injection pathway into an ion selection device having ion selection device ion optics; selecting a subset of the ions in the ion selection device; wherein the subset of the ions have a preselected range of mass-to-charge ratios; and transmitting the subset of the ions having the preselected range of mass-to-charge ratios along a second direction toward the inlet through the ion injection pathway; wherein the ion injection pathway ion optics have an RF voltage component and a DC voltage component which are under independent control with respect to the ion selection device ion optics; wherein the ion injection pathway ion optics comprise two or more multipole RF devices and one or more ion lens devices, wherein the multipole RF devices and the ion lens devices are provided between the inlet and the ion selection device and wherein at least one ion lens device is provided between adjacent multipole RF devices; and wherein the subset of the ions transmitted along the second direction interact with one or more gases at a pressure greater than 0.01 Torr in the inlet or ion injection pathway and undergo dissociation, thereby fragmenting at least a portion of the subset of the ions having the preselected range of mass-to-charge ratios to generate the product ions.

In an aspect of this embodiment, the method further comprises repeating the transmitting and selecting steps one or more times, the method comprising the steps of: transmitting the product ions along the first direction through the ion injection pathway into the ion selection device; selecting a subset of the product ions in the ion selection device; wherein the subset of the product ions have a preselected range of mass-to-charge ratios; and transmitting the product ions having the preselected range of mass-to-charge ratios along a second direction toward the inlet through the ion injection pathway into at least a portion of the inlet; wherein the ion injection pathway ion optics have an RF voltage component and a DC voltage component which are under independent control with respect to the ion selection device ion optics; wherein the ion injection pathway ion optics comprise two or more multipole RF devices and one or more ion lens devices, wherein the multipole RF devices and the ion lens devices are provided between the inlet and the ion selection device and wherein at least one ion lens device is provided between adjacent multipole RF devices; wherein the subset of the product ions transmitted along the second direction interact with one or more gases at a pressure greater than 0.01 Torr in the inlet or ion injection pathway and undergo dissociation; thereby fragmenting at least a portion of the subset of the product ions having the preselected range of mass-to-charge ratios.

In another embodiment a method is provided for analyzing a sample using mass spectrometry, the method comprising: generating ions from the sample using an ion source; transmitting the ions from the ion source through an inlet into an ion injection pathway having ion injection pathway ion optics; transmitting the ions along a first direction away from the inlet through the ion injection pathway into an ion selection device having ion selection device ion optics; selecting a subset of the ions in the ion selection device; wherein the subset of the ions have a preselected range of mass-to-charge ratios; and transmitting the subset of the ions having the preselected range of mass-to-charge ratios along a second direction toward the inlet through the ion injection pathway; wherein the ion injection pathway ion optics have an RF voltage component and a DC voltage component which are under independent control with respect to the ion selection device ion optics; wherein the ion injection pathway ion optics comprise two or more multipole RF devices and one or more ion lens devices, wherein the multipole RF devices and the ion lens devices are provided between the inlet and the ion selection device and wherein at least one ion lens device is provided between adjacent multipole RF devices; wherein the subset of the ions transmitted along the second direction interact with one or more gases at a pressure greater than 0.01 Torr in the inlet or ion injection pathway and undergo dissociation, thereby fragmenting at least a portion of the subset of the ions having the preselected range of mass-to-charge ratios to generate product ions; and analyzing the product ions using the ion selection device or a secondary mass analyzer, thereby analyzing the sample using mass spectrometry.

In an aspect of this embodiment a method is provided further comprising repeating the transmitting and selecting steps one or more times, the method comprising the steps of: transmitting the product ions along the first direction through the ion injection pathway into the ion selection device; selecting a subset of the product ions in the ion selection device; wherein the subset of the product ions have a preselected range of mass-to-charge ratios; transmitting the product ions having the preselected range of mass-to-charge ratios along a second direction toward the inlet through the ion injection pathway; wherein the ion injection pathway ion optics have an RF voltage component and a DC voltage component which are under independent control with respect to the ion selection device ion optics; wherein the ion injection pathway ion optics comprise two or more multipole RF devices and one or more ion lens devices, wherein the multipole RF devices and the ion lens devices are provided between the inlet and the ion selection device and wherein at least one ion lens device is provided between adjacent multipole RF devices; wherein the subset of the product ions transmitted along the second direction interact with one or more gases at a pressure greater than 0.01 Torr in the inlet or ion injection pathway and undergo dissociation, thereby fragmenting at least a portion of the subset of the product ions having the preselected range of mass-to-charge ratios to generate secondary product ions; and analyzing the secondary product ions using the ion selection device or a secondary mass analyzer, thereby analyzing the sample using mass spectrometry.

In an embodiment, for example, the method further comprises selecting a DC voltage component of the one or more ion lens devices to trap at least a portion of the product ions in one of the two or more multipole RF devices; wherein the DC voltage component of the one or more ion lens devices is greater than a DC voltage component of one of the two or more multipole RF devices.

In an embodiment, for example, the method further comprises selecting the RF voltage component and a DC voltage components of the two or more multipole RF devices to establish a potential gradient between the two or more multipole RF devices to accelerate the subset of the ions transmitted along the second direction to an average kinetic energy selected over the range of 10 eV to 150 eV sufficient to enable beam-type collision activated dissociation of the ions transmitted along the second direction in the inlet or ion injection pathway. In an aspect, the DC voltage component is selected over the range of 0 V to 150 V.

In an embodiment, for example, the method further comprises selecting the RF voltage component and a DC voltage component of the one or more ion lens devices to enable ion reaction dissociation of the ions transmitted along the second direction in the inlet or ion injection pathway. In an aspect, the RF voltage component is selected over the range of 200 V to 800 V.

In an embodiment the ion lens devices and multipole RF devices provide spatial focusing of ions in the ion injection pathway.

In an embodiment, the ion lens devices comprise an aperture which allows for a pressure differential to be established between a first side of the ion lens device and a second side of the ion lens device. In an aspect, the pressure differential is selected to enable beam-type collision activated dissociation, ion reaction dissociation, electron reaction dissociation, neutral reaction dissociation, or laser-induced dissociation in the inlet or ion injection pathway of the ions transmitted along the second direction. In another aspect, the pressure differential is selected over the range of $10^{-6}$ Torr to 10 Torr.

The devices and methods described herein are compatible with a range of dissociation types. In an embodiment, for example, the subset of the ions transmitted along the second direction interact with one or more gases at a pressure greater than 0.01 Torr in the inlet and/or ion injection pathway. In some embodiments, ions are transmitted along the second direction with a high degree of kinetic energy and collide with gases in the pre-injection pathway, thereby undergoing beam-type collision-activated dissociation to generate product ions. In an embodiment, for example, the subset of the ions transmitted along the second direction undergo chemical reaction(s) with reagent ions provided in the inlet and/or ion injection pathway, thereby undergoing ion reaction dissociation to generate product ions. In an embodiment, for example, the subset of the ions transmitted along the second direction interact with electrons in the inlet and/or ion injection pathway, thereby undergoing electron reaction dissociation to generate product ions. In an embodiment, for example, the subset of the ions transmitted along the second direction undergo chemical reaction(s) with reagent molecules in the inlet and/or ion injection pathway, thereby undergoing neutral reaction dissociation to generate product ions. In an embodiment, for example, the subset of the ions transmitted along the second direction absorb electromagnetic radiation in the ion injection pathway or inlet from a laser source, thereby undergoing laser-induced dissociation. In embodiments wherein the subset of the ions transmitted along the second direction interact with one or more gases at a pressure greater than 0.01 Torr in the inlet and/or ion injection pathway and undergo beam-type collision-activated dissociation, the subset of ions are transmitted along the second direction with a high degree of kinetic energy. In embodiments wherein the subset of the ions transmitted along the second direction interact with one or more gases at a pressure greater than 0.01 Torr in the inlet and/or ion injection pathway and undergo ion reaction dissociation, electron reaction dissociation, or neutral reaction dissociation, the subset of ions are transmitted along the second direction with a modest degree of kinetic energy. In an aspect, the subset of the ions transmitted along the second direction interact with one or more gases at a pressure greater than 0.01 Torr in the inlet and undergo beam-type collision activated dissociation. In an aspect, the ions are transmitted along the first direction away from the inlet through the ion injection pathway into the ion selection device without undergoing substantial dissociation.

The methods and devices described herein are compatible with many voltages on the ion optical elements. In an embodiment, for example, the DC voltage component is selected over the range of −125 V to 125 V. In a related aspect, the RF voltage component is selected over the range of 200 V to 800 V, optionally 400 V to 800 V at a frequency selected over the range of 1 MHz to 5 MHz. In a related embodiment, the ion injection pathway ion optics provide a voltage offset between the inlet and the ion selection device selected over the range −125 V to +125 V.

The methods of these embodiments can comprise one or more additional steps. In an aspect, the method further comprises the step of transmitting the product ions to the ion selection device or to a secondary mass analyzer and analyzing the mass-to-charge ratios of the product ions using the ion selection device or the secondary mass analyzer. The methods and devices described herein are advantageous in that the methods and devices are compatible with respect to a wide range of voltages applied to the mass analyzer and ion selection devices. In another aspect, the second direction is opposite to the first direction.

The method can be practiced in the context of different pressure regions. In an embodiment, for example, the subset of the ions transmitted along the second direction interact with one or more gases at a pressure selected over the range of 0.01 Torr to 1000 Torr in the inlet or ion injection pathway and undergo dissociation. In a related aspect, the ion injection pathway is housed within one or more differentially pumped chambers, wherein the pressure decreases from a value of 1 Torr to 1000 Torr at the inlet to a value of $10^{-10}$ Torr to 0.1 Torr at the ion selection device.

The energy with which the ions are transmitted into a fragmentation region, such as into the ion injection pathway or inlet, is an important parameter. The kinetic energy of the ions necessary for beam-type collision-activated dissociation, for example, tends to increase with the mass-to-charge ratio of the precursor ions, due to the generally higher degrees of freedom. The kinetic energy of the ions necessary to enable ion reaction dissociation, electron reaction dissociation, and/or neutral reaction dissociation, however, tend to require a more modest degree of kinetic energy than for beam-type collision-activated dissociation. In an embodiment, for example, the subset of the ions having the preselected range of mass-to-charge ratios is transmitted along the second direction through the ion injection pathway with an average kinetic energy greater than or equal to 1 eV. In another embodiment, the subset of the ions having the preselected range of mass-to-charge ratios is transmitted along the second direction through the ion injection pathway with an average kinetic energy selected over the range of 1 eV to 300 eV, over the range of 1 eV to 150 eV, over the range of 10 eV to 150 eV, over the range of 10 eV to 300 eV, or over the range of 10 eV to 70 eV. In a related embodiment, the subset of the ions having the preselected range of mass-to-charge ratios are accelerated by ion optics in the ion injection pathway and/or inlet to achieve the average kinetic energy greater than or equal to 1 eV.

The time the ions spend in the ion injection pathway and inlet is important for facilitating ion fragmentation processes. In an embodiment, for example, the subset of the ions transmitted along the second direction is provided in the ion injection pathway for a residence time greater than or equal to 1 millisecond. In an aspect, the subset of the ions transmitted along the second direction is provided in the ion injection pathway for a residence time selected from the range of 1 millisecond to 1 second. In another embodiment, for example, the subset of the ions transmitted along the second direction is provided in the inlet for a residence time greater than or equal to 1 millisecond. In an aspect, the subset of the ions transmitted along the second direction is provided in the inlet for a residence time selected from the range of 1 millisecond to 1 second.

The methods described herein are useful for a wide range of ion mass-to-charge ratios. In an embodiment, the subset of the ions transmitted along the second direction toward the inlet through the ion injection pathway have mass-to-charge ratios selected over the range of 50 Da $e^-$ to 5000 Da $e^-$, preferably 135 Da $e^-$ to 2000 Da $e^-$. In an embodiment, the subset of the ions transmitted along the second direction toward the inlet have mass-to-charge ratios selected over the range of 50 Da $e^-$ to 5000 Da $e^-$, preferably 135 Da $e^-$ to 2000 Da $e^-$. In an embodiment, the product ions have mass-to-charge ratios selected over the range of 50 Da $e^-$ to 2000 Da $e^-$, preferably 50 Da $e^-$ to 1000 Da $e^-$. In an aspect, the product ions have mass-to-charge ratios greater than or equal to 50 Da $e^-$.

For certain embodiments, it can be desired that ions only undergo fragmentation processes in selected portions of a mass spectrometer. In an embodiment, for example, the ions are transmitted along the first direction away from the inlet through the ion injection pathway into the ion selection device without undergoing substantial dissociation In an embodiment, the ions are transmitted along the first direction away from the inlet through the ion injection pathway into the ion selection device without undergoing substantial collision-activated dissociation.

The methods described herein are useful in a wide range of mass spectrometer instruments. In an embodiment, the method is implemented in a tandem mass spectrometer instrument or a multistage mass spectrometer instrument. In an aspect, the method is implemented in a tandem mass spectrometer instrument or a multistage mass spectrometer instrument not having a separate collision cell.

Steps of the method can be repeated, for example in the context of an $MS^n$ experiment, to create secondary product ions. In an aspect, the method further comprises repeating the transmitting and selecting steps one or more times, the method comprising the steps of: transmitting the product ions along the first direction through the ion injection pathway into the ion selection device; selecting a subset of the product ions in the ion selection device; wherein the subset of the product ions have a preselected range of mass-to-charge ratios; and transmitting the product ions having the preselected range of mass-to-charge ratios along a second direction toward the inlet through the ion injection pathway into at least a portion of the inlet; wherein the ion injection pathway ion optics have an RF voltage component and a DC voltage component which are under independent control with respect to the ion selection device ion optics; wherein the ion injection pathway ion optics comprise two or more multipole RF devices and one or more ion lens devices, wherein the multipole RF devices and the ion lens devices are provided between the inlet and the ion selection device and wherein at least one ion lens device is provided between adjacent multipole RF devices; and wherein the subset of the product ions transmitted along the second direction interact with one or more gases at a pressure greater than 0.01 Torr in the inlet or ion injection pathway and undergo dissociation; thereby fragmenting at least a portion of the subset of the product ions having the preselected range of mass-to-charge ratios.

The methods described herein are compatible with many inlet and ion injection pathway configurations and pressures. In an embodiment, for example, the inlet is an atmospheric pressure inlet in fluid communication with the ion source. In an embodiment, the ion injection pathway is housed within one or more chambers having ion injection pathway ion optics for transmitting the ions along the first direction and for transmitting the subset of ions along the second direction. In a related embodiment, the ion injection pathway is housed within one or more differentially pumped chambers, wherein the pressure decreases from a value of 0.001 Torr to 1000 Torr at the inlet; optionally 1 Torr to 1000 Torr at the inlet, to a value of $10^{-10}$ Torr to 0.1 Torr at the ion selection device. In another embodiment, the ion injection pathway is housed within one or more chambers having ion optics for transmitting the ions along the first direction and for transmitting the subset of ions along the second direction.

The methods described herein are useful with a range of ion optics and ion optics configurations and voltages. In an embodiment, for example, the ion injection pathway ion optics provide a voltage offset between the inlet and the ion selection device selected over the range −125 eV to +125 eV, optionally over the range of −500 eV to +500 eV, −250 eV to +250 eV, or −1000 eV to +1000 eV.

In another embodiment, the ion optics of the chambers comprise one or more multipole RF devices provided between the inlet and the ion selection device. For example, wherein the step of transmitting the subset of the ions having the preselected range of mass-to-charge ratios along the second direction comprises re-injecting the subset of the ions into one or more multipole RF devices provided between the inlet and the ion selection device. In an aspect, the step of transmitting the subset of the ions having the preselected range of mass-to-charge ratios along the second direction comprises re-injecting the subset of the ions into two multipole RF devices provided between the inlet and the ion selection device, wherein an ion lens is provided between the multipole devices.

In another embodiment, the ion optics of the chambers comprise an ion lens, a first multipole RF device, and a second multipole RF device provided between the inlet and the ion selection device and in fluid communication with each other; wherein the first multipole RF device is proximate to the inlet, the second multipole RF device is proximate to the ion selection device, and the ion lens is provided between the first multipole RF device and the second multipole RF device; wherein the step of transmitting the subset of the ions having the preselected range of mass-to-charge ratios along the second direction comprises re-injecting the subset of the ions into the first and second multipole RF devices.

In another embodiment, the ion optics of the chambers further comprise one or more ion lenses provided between a multipole RF device and the inlet; or provided between a first multiple RF device and a second multipole RF device; or provided between a multipole RF device and the ion selection device. The methods and devices described herein can have a wide range of components, such as ion optics, provided between the inlet and the RF devices. Example components include, but are not limited to, ion lenses, vacuum pumps, and apertures, among others. In an embodiment, for example, the ion lenses described herein are provided with an aperture which separates first and second vacuum regions of the chamber.

Many ion selection devices are compatible with the methods described herein. In an embodiment, for example, the ion selection device is an ion trap or mass analyzer. In an aspect, the ion selection device is a quadrupole ion trap, Fourier transform ion cyclotron resonance ion trap, a linear quadrupole ion trap, an orbitrap ion trap, a quadrupole mass analyzer or a time of flight mass analyzer. In an aspect, the ion selection device is not an orbitrap ion trap. In an aspect, the ion selection device is not a time of flight mass analyzer.

Many ion sources are compatible with the methods described herein. In an embodiment, for example, the ion source is an atmospheric ion source. In an aspect, the ion source is an electrospray ionization source, a MALDI source, a chemical ionization source, a laser desorption source, a sonic spray source, a photoionization source, a desorption source, or a fast ion bombardment source. In an aspect, the ion source is an electrospray ionization source or a MALDI source. In an embodiment, the ions are generated from proteins, peptides, small molecules, lipids, metabolites, or drugs. In an aspect, the ions are generated from phosphorylated proteins or peptides. In an aspect, the ions are generated from isobarically labeled peptides. In an aspect, the ions are generated from peptides that are fractionated prior to generation of the ions.

The methods described herein can be practiced with other related methods. In an embodiment, for example, the sample is analyzed using tandem mass spectrometry or multistage mass spectrometry.

Methods described herein can comprise one or more additional steps, in an embodiment, the methods further comprise fractionating the sample prior to the step of generating ions from the sample using the ion source. In a related embodiment, the sample comprises peptides or proteins. In an aspect, the sample comprises phosphorylated peptides or isobarically labeled peptides.

The method can also be practiced in the context of many different mass spectrometer devices. In an embodiment, for example, a mass spectrometer device for analyzing a sample is provided, the device comprising: an ion source for generating ions from the sample; one or more chambers having an inlet for receiving the ions and having ion injection pathway ion optics for transmitting the ions along an ion injection pathway between the inlet and an ion selection device; the ion selection device having ion selection device ion optics, the ion selection device in fluid communication with the one or more chambers for receiving the ions and selecting a subset of the ions having a preselected range of mass-to-charge ratios; and a controller operably connected to the ion optics of the one or more chambers; wherein the controller controls the ion optics so as: to transmit the ions along a first direction away from the inlet through the ion injection pathway into the ion selection device; and to transmit the subset of the ions having the preselected range of mass-to-charge ratios along a second direction toward the inlet through the ion injection pathway; wherein the ion injection pathway ion optics have an RF voltage component and a DC voltage component which are under independent control with respect to the ion selection device ion optics; wherein the ion injection pathway ion optics comprise two or more multipole RF devices and one or more ion lens devices, wherein the multipole RF devices and the ion lens devices are provided between the inlet and the ion selection device and wherein at least one ion lens device is provided between adjacent multipole RF devices; wherein the subset of the ions transmitted along the second direction interact with one or more gases at a pressure greater than 0.01 Torr in the inlet or ion injection pathway and undergo dissociation, thereby fragmenting at least a portion of the subset of the ions having the preselected range of mass-to-charge ratios to generate the product ions.

The devices described herein can be configured to manipulate ions in many different ways. In an embodiment, for example, the ion selection device receives the product ions and analyzes the product ions.

The devices described herein can comprise many device configurations. In an embodiment, the mass spectrometer device further comprises a secondary mass analyzer for receiving and analyzing the mass-to-charge ratios of the product ions. In an embodiment, the device does not have a separate collision cell. In an aspect, the ion optics comprise one or more multipole RF devices provided between the inlet and the ion selection device; wherein the one or more multipole RF devices re-inject the subset of the ions into the ion injection pathway provided between the inlet and the ion selection device. In an embodiment, the mass spectrometer device further comprises a separation stage operably connected to the ion source for fractionating the sample prior to generation of the ions. In an aspect, the separation stage is a liquid chromatography separation system or a capillary electrophoresis separation system.

In an embodiment, the methods and devices are useful with a range of ion manipulation devices. In an aspect, the ion manipulation device is an ion selection device, for example, an ion trap or mass analyzer. In another aspect, the ion manipulation device is an ion selection device which receives the product ions and analyzes the product ions. In a further aspect, the ion manipulation device is a secondary mass analyzer for receiving and analyzing the mass-to-charge ratios of the product ions.

Without wishing to be bound by any particular theory, there can be discussion herein of beliefs or understandings of underlying principles or mechanisms relating to the invention. It is recognized that regardless of the ultimate correctness of any explanation or hypothesis, an embodiment of the invention can nonetheless be operative and useful.

DETAILED DESCRIPTION

Figure 1:
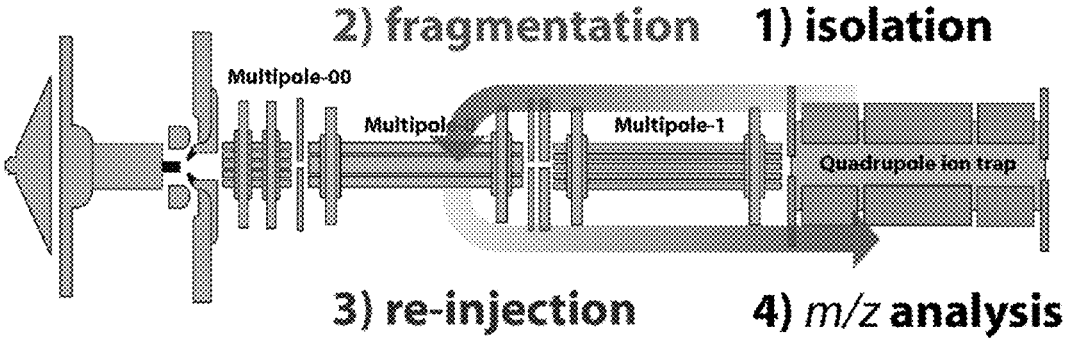
FIG. 1 provides a schematic showing ion optical device components and an ion fragmentation and detection method described herein.

Referring to the drawings, like numerals indicate like elements and the same number appearing in more than one drawing refers to the same element. In general the terms and phrases used herein have their art-recognized meaning, which can be found by reference to standard texts, journal references and contexts known to those skilled in the art. The following definitions are provided to clarify their specific use in the context of the invention.

As used herein, the terms "product ion" and "secondary ion" are used interchangeably in the present description and refer to an ion which is produced during a fragmentation process of a precursor ion. The term "secondary product ion" as used herein refers to an ion which is the product of successive beam-type collision-activated dissociation fragmentations.

As used herein, the term "independent control" refers to the ability to control an element independently of other elements. Ion injection pathway ion optics, for example, can be under independent control with respect to ion optics of other elements described herein. In an embodiment, for example, the voltages of ion optics of an ion injection pathway are under independent control with respect to the voltages of an ion selection device. Elements of the invention which are under independent control include, but are not limited to, ion injection pathway ion optics described herein, such as RF multipoles of the ion injection pathway in which the DC voltage and RF amplitude voltage are under independent control with respect to other ion optical elements, for example ion optical elements of an ion selection device.

As used herein, the term "beam-type collision-activated dissociation" refers to the process of dissociating precursor ions by accelerating the ions to a high kinetic energy and colliding the ions with a background gas, causing dissociation or fragmentation of the precursor ions. In an embodiment, for example, precursor ions are accelerated to a high kinetic energy and collided with a high pressure background gas, for example a pressure greater than 0.01 Torr, in an ion injection pathway or inlet which results in the production of product ions from dissociation or fragmentation of the precursor ions. The background gas can comprise constituents of air or other gas from an ion source, for example helium, nitrogen, oxygen, and/or argon.

As used herein, the term "ion reaction dissociation" refers to a process whereby precursor ions react with another ionic species and the reaction products include product ions produced by fragmentation of the precursor ions. In an embodiment, for example, the reaction is an electron transfer dissociation reaction in which electrons are transferred to the precursor ions from a radical ion species. In an aspect, the radial ion species is an anthracene, azobenzene, or derivative or mixture thereof.

As used herein, the term "electron reaction dissociation" refers to a process whereby precursor ions react with electrons and the reaction products include product ions produced by fragmentation or dissociation of the precursor ions. In an embodiment, for example, the electron reaction dissociation is an electron capture dissociation in which low kinetic energy electrons react with the precursor ions and result in the dissociation of at least a portion of the precursor ions to form product ions. In an embodiment, for example, at least a portion of the product ions retain at least one post-translational modification of the parent ions, such as phosphorylation and/or O-glycosylation.

As used herein, the term "neutral reaction dissociation" refers to a process whereby precursor ions react with one or more neutral species and the reaction products include product ions produced by dissociation or fragmentation of the precursor ions. In an embodiment, for example, the reaction is a charge remote, charge transfer, or charge-exchange fragmentation or dissociation reaction.

As used herein, the term "laser-induced dissociation" refers to a process whereby precursor ions interact with electromagnetic radiation from a laser source causing dissociation or fragmentation of the precursor ions. In an embodiment, for example, the electromagnetic radiation from the laser source is infrared electromagnetic radiation, visible electromagnetic radiation, or ultraviolet electromagnetic radiation. In a further embodiment, the electromagnetic radiation is x-ray electromagnetic radiation or gamma ray electromagnetic radiation.

As used herein, the term "ion source" refers to a device component which produces ions from a sample. Examples of ion sources include, but are not limited to, electrospray ionization sources, MALDI sources, chemical ionization sources, laser desorption sources, sonic spray sources, photoionization sources, desorption sources, and fast ion bombardment sources.

As used herein, the term "inlet" refers to a device component which separates a high pressure region and a low pressure region. Inlets can include atmospheric pressure inlets which separate an atmospheric high pressure region from a low pressure region. Inlets can be provided between an ion source and an ion injection pathway and can be a region used for fragmentation and dissociation, such as collisional activated dissociation, as described herein.

As used herein, the term "ion injection pathway" refers to an area within a device component where an ion beam is formed and prepared for injection into a mass analyzer or ion selection device. As used herein, the term "re-injection" refers to the formation of an ion beam and preparation for injection into a mass analyzer or ion selection device of production ions.

As used herein, the term "ion selection device" refers to a device which separates ions. Ion selection devices can separate ions, for example, according to the mass-to-charge ratio, charge, mass, or kinetic energy of the ions.

As used herein, the term "mass analyzer" refers to a device which separates particles, especially ions, according to the mass of the ions. Mass analyzers can also separate ions according to their mass-to-charge ratios. Mass analyzers include secondary mass analyzers which separate product ions according to their mass.

As used herein, the term "mass-to-charge ratio" refers to the ratio of the mass of a species to the charge state of a species.

As used herein, the term "ion trap" refers to a device which captures ions in a region of a vacuum system. Ion traps include, but are not limited to, quadrupole ion traps, Fourier transform ion cyclotron resonance ion traps, linear quadruple ion traps, orbitrap ion traps, and quadrupole mass analyzers.

As used herein, the term "ion optic" refers to a device component which assists in the transport and manipulation of charged particles, for example ions, by the application of electric and/or magnetic fields. The electric or magnetic field can be static, alternating, or can contain both static and alternating components. Ion optical device components include, but are not limited to, ion deflectors which deflect ions, ion lenses which focus ions, and multipoles (such as quadruples) which confine ions to a specific space or trajectory. Ion optics can include multipole RF device components which comprise multiple rods having both static and alternating electric and/or magnetic fields.

As used herein, the term "voltage offset" refers to the difference in static electric potential between two ion optic elements.

As used herein, the term "average kinetic energy" refers to the median or mean value of a distribution of kinetic energies, for example a distribution of ion kinetic energies.

As used herein, the term "residence time" refers to the average amount of time that a particle, such as an ion, spends in a particular system or region of a system. Residence time can refer to, for example, the average amount of time that an ion spends in a region of a mass spectrometer, such as a mass analyzer, secondary mass analyzer, ion trap, or other ion selection device. For some systems the residence time can be related to the mass of the ion in an ion selection device.

As used herein, the term "mass spectrometer" refers to a device which creates ions from a sample, separates the ions according to mass, and detects the mass and abundance of the ions. Mass spectrometers include multistage mass spectrometers which fragment the mass-separated ions and separate the product ions by mass one or more times. Multistage mass spectrometers include tandem mass spectrometers which fragment the mass-separated ions and separate the product ions by mass once.

A used herein, the term "differentially pumped chamber" refers to a vacuum chamber which has regions of different local pressure which are in fluid communication with each other. The regions of different local pressure can be separated by an aperture to allow fluid communication between the regions. Likewise, two or more differentially pumped chambers can be in fluid communication with each other and be separated by apertures to allow fluid communication between the two or more differentially pumped chambers. Differentially pumped chambers can comprise one or more ion optical elements, such as multipoles, lenses, and ion selection devices.

As used herein, the term "collision cell" refers to a section of a mass spectrometer containing one or more neutral gases which interact with a beam of ions and the interaction fragments at least a portion of the ions. The term "collision cell" does not refer to an ion injection pathway between an ion source inlet and an ion selection device.

As used herein, the term "fluid communication" refers to elements, such as device elements, which are in fluid contact with each other. A fluid can include, but is not limited to, a gas, a liquid, or a super-critical fluid. Elements which are in fluid contact with each other can pass gasses, for example gasses containing ions, between them.

The terms "peptide" and "polypeptide" are used synonymously in the present description, and refer to a class of compounds composed of amino acid residues chemically bonded together by amide bonds (or peptide bonds). Peptides and polypeptides are polymeric compounds comprising at least two amino acid residues or modified amino acid residues. Modifications can be naturally occurring or non-naturally occurring, such as modifications generated by chemical synthesis. Modifications to amino acids in peptides include, but are not limited to, phosphorylation, glycosylation, lipidation, prenylation, sulfonation, hydroxylation, acetylation, methionine oxidation, alkylation, acylation, carbamylation, iodination and the addition of cofactors. Peptides include proteins and further include compositions generated by degradation of proteins, for example by proteolyic digestion. Peptides and polypeptides can be generated by substantially complete digestion or by partial digestion of proteins. Polypeptide targeting ligands include, for example, polypeptides comprising 1 to 100 amino acid units, optionally for some embodiments 1 to 50 amino acid units and, optionally for some embodiments 1 to 20 amino acid units.

"Protein" refers to a class of compounds comprising one or more polypeptide chains and/or modified polypeptide chains. Proteins can be modified by naturally occurring processes such as post-translational modifications or co-translational modifications. Exemplary post-translational modifications or co-translational modifications include, but are not limited to, phosphorylation, glycosylation, lipidation, prenylation, sulfonation, hydroxylation, acetylation, methionine oxidation the addition of cofactors, proteolysis, and assembly of proteins into macromolecular complexes. Modification of proteins can also include non-naturally occurring derivatives, analogues and functional mimetics generated by chemical synthesis. Exemplary derivatives include chemical modifications such as alkylation, acylation, carbamylation, iodination or any modification that derivatizes the protein.

As used herein, the term "controller" refers to a device component which can be programmed to control a device or system, as is well known in the art. Controllers can, for example, be programmed to control mass spectrometer systems as described herein. Controllers can be programmed, for example, to carry out ion manipulation and sample analysis methods as described herein on systems and devices as described herein.

As used herein, the term "fractionated" or "fractionate" refers to the physical separation of a sample, as is well known in the art. A sample can be fractionated according to physical properties such as mass, length, or affinity for another compound, among others using chromatographic techniques as are well known in the art. Fractionation can occur in a separation stage which acts to fractionate a sample of interest by one or more physical properties, as are well known in the art. Separation stages can employ, among other techniques, liquid and gas chromatographic techniques. Separation stages include, but are not limited to, liquid chromatography separation systems, gas chromatography separation systems, affinity chromatography separation systems, and capillary electrophoresis separation systems.

Ion trap mass spectrometers are among the most widely used platforms for molecular analysis—spanning natural products, to pharmaceuticals, to biologics such as proteins. Most mass spectrometer-based experiments begin with the isolation of a group of compounds from a set of samples through some sort of extraction technique, e.g., proteins from tissues, cell lysates, or fluids followed by proteolytic digestion of those proteins into peptides (i.e., bottom-up proteomics). Frequently but not necessarily the mass spectrometers are then coupled with some form of separations, e.g., electrophoretic or chromatographic. Over the course of just a few hours, MS instruments can autonomously interrogate tens of thousands of molecular species via tandem mass spectrometry.

Although some of the initial descriptions of low-energy collision activated dissociation tandem mass spectrometric analysis were performed using beam-type dissociation on triple quadrupole mass spectrometers, due to the speed and sensitivity of quadrupolar ion trap analyzers, resonant-excitation CAD is arguably the most widely used dissociation method for many common types of analyses (e.g., bottom-up proteomics, glycomics, etc.). Recently though, there has been a surge in interest in beam-type collision activated dissociation—particularly its application towards the interrogation of precursors that are typically not amenable to resonant excitation collision activated dissociation (e.g., phosphorylated peptides, metabolites, etc.).

Developed in parallel with these rising interests, hybrid instruments that possess multiple analyzers and multiple means of peptide fragmentation—including beam-type collision activated dissociation—have become common place (e.g., the LTQ-Orbitrap, and the Velos-Orbitrap). One common element to all of these instruments that are capable of beam-type collision activated dissociation, is that they have dedicated collision cells for conducting the fragmentation technique. So the price for enabling beam-type collision activated dissociation on these instruments is increasing instrument complexity.

As an alternative to relying on instruments of increasing complexity and cost, our invention enables beam-type collision activated dissociation on a range of pre-existing instruments without requiring any hardware modifications. With most conventional mass spectrometers a stream of ions is transmitted from an atmospheric pressure inlet to an ion selection/analysis device using a collection of RF devices, tubes and lenses. These ion optics elements pass through differentially pumped regions as they connect the atmospheric pressure inlet to the ion selection/analysis device. We've demonstrated that following injection and selection of a particular ion type or ion population, those ions can be fragmented via beam-type CAD using the pre-existing ion injection pathway and/or inlet of the mass spectrometer. This is achieved by transmitting the ions back along the ion injection pathway with a high degree of kinetic energy. As the ions pass into the higher pressure regions located near the atmospheric pressure inlet having pressures, for example, greater than 0.01 Torr, the ions are fragmented and then trapped. Following activation and trapping, the ions can either be re-injected into the primary ion selection device or else sent on to a secondary analyzer.

This fragmentation technique is somewhat analogous to in-source dissociation. In both cases the high pressures and strong electric fields of the ion optics located near the source region are exploited to fragment the precursor ions. But, the timing of when the two fragmentation techniques are employed relative to the rest of the scan cycle differs greatly. During in-source dissociation all the ions emitted from the source are collisionally activated as they make their initial journey from the atmospheric inlet to the ion trap. Alternatively, during our technique the emitted ions are transferred to the ion trap without any collisional activation. Following injection, one precursor ion type or a series of ion types is isolated and then re-injected into the ion optics between the inlet and the ion trap, where it is then collisionally activated.

During the development of this fragmentation technique all the voltages applied to the ion optics, both when the ions are ejected into the front ion optics and when the product ions are transmitted into the ion trap, were carefully optimized. Additionally, all the times associated with each of the individual steps of the experiment were carefully controlled. As an added benefit of this characterization work, this information formed the foundation for a normalized collision energy algorithm that can predict the optimal voltages for producing an informative tandem mass spectrum from a given precursor ion (i.e., the voltages at which the precursor-to-product conversion efficiency is at its highest). This powerful tool allows the user to hand over direct control of the experiment to the instrument, which can automatically determine how to interrogate a particular precursor in a data-dependent manner using this algorithm.

If the user chooses to, they can retain direct control over the experiment. Through the existing user interface, the user can easily vary many of the experimental variables of this fragmentation technique. For example, the user has complete control over the fragmentation energy—i.e. both the voltage offset between the front ion optics and the quadrupole ion trap as well as many of the voltages applied to the ion optics in between these two points. In this way the user can bias the experiment towards only the lower-energy fragmentation pathways or they can increase the offset and in-turn access the high-energy pathways. This powerful flexibility allows the instrument operator to tune the experiment to better suit the varying precursor chemistries one can expect to encounter during the operation of a mass spectrometer. For example, during the interrogation of phosphopeptides higher collision energies are generally necessary to fragment the backbone bonds of the peptide, whereas the non-phosphorylated species should fragment under less energetic conditions.

The fragmentation technique is particularly well suited for the interrogation of precursors that generate low m/z product ions relative to the precursor m/z ratio. Typically, when these types of precursors are fragmented by resonant excitation collision activated dissociation, the resulting low m/z product ions fall beneath the low-mass cutoff of that fragmentation technique. Alternatively, our implementation of beam-type collision activated dissociation is in general indifferent to the RF amplitude of the ion optics. Hence, we can fragment ions at RF amplitudes that allow for a dramatically lower low-mass cutoff, which in turn allows us to retain any low m/z fragments. For example, peptides labeled with isobaric tags for relative quantitation (e.g., iTRAQ and TMT) can possess large precursor m/z ratios (>1000 m/z), yet the quantitative reporter ions have quite low m/z ratios (<150 m/z). During a typical resonant excitation collision activated dissociation experiment these lighter reporter ions would be invisible to the user because they would fall beneath the low-mass cutoff enforced by the fragmentation technique, yet by our technique their formation and detection is quite feasible.

Figure 2:
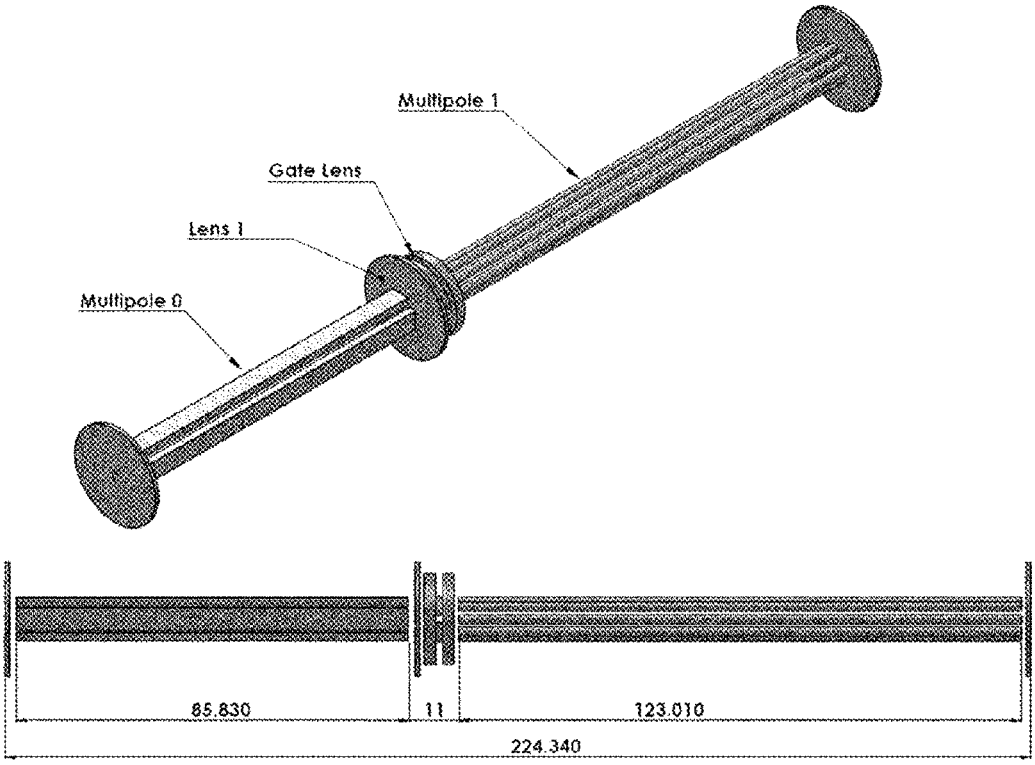
FIG. 2 provides a schematic showing ion optical device components described herein.
Figure 3:
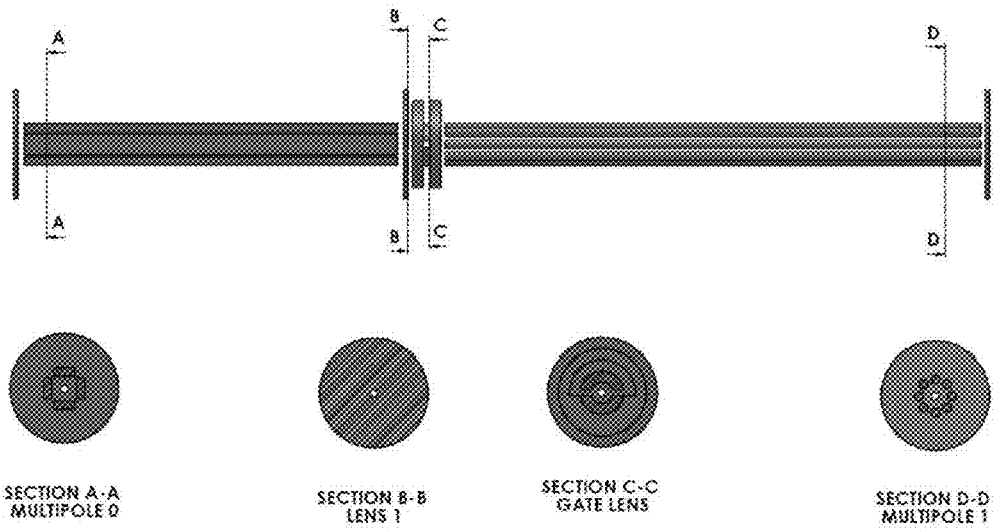
FIG. 3 provides a schematic showing ion optical device components described herein.
Figure 4:
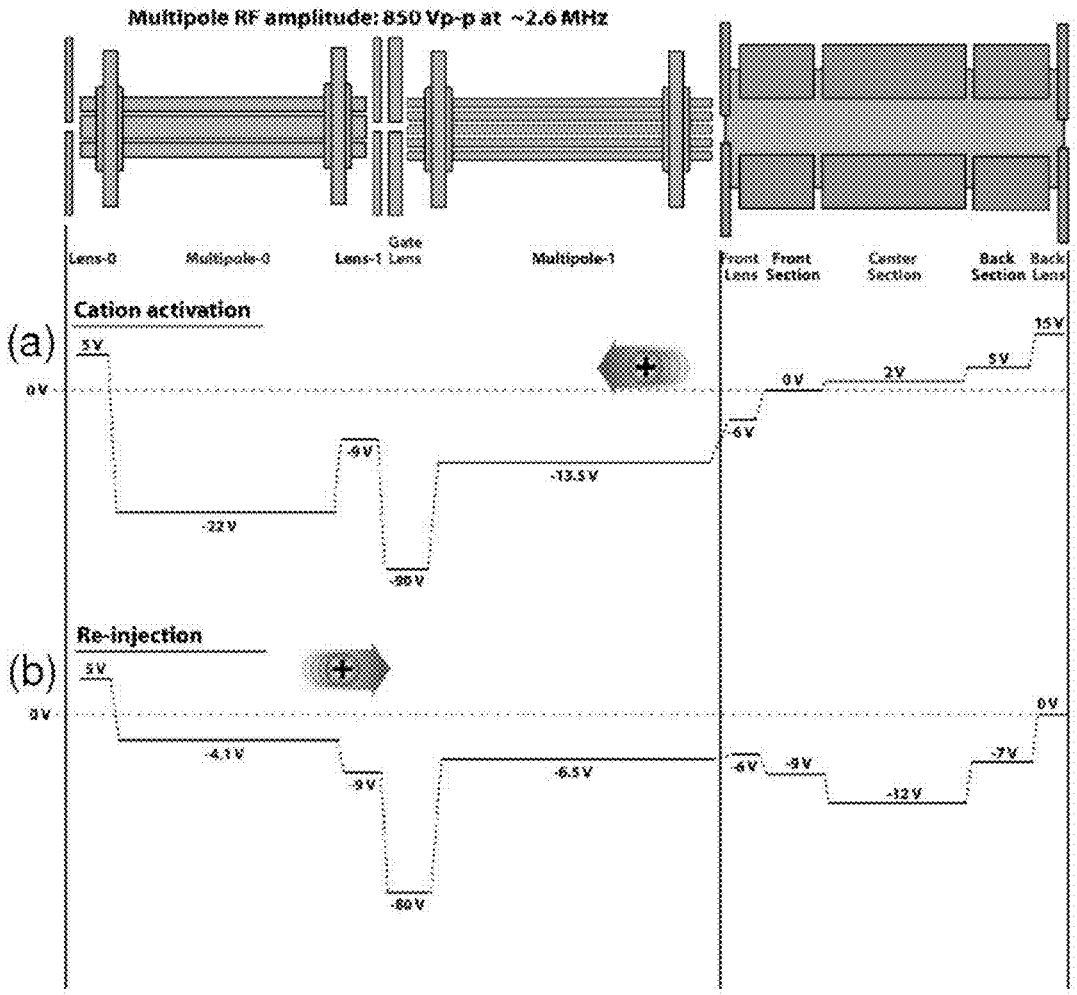
FIG. 4 provides a schematic showing ion optical device components and voltages applied for (a) positive ion fragmentation and (b) positive ion re-injection.

In an embodiment, the invention comprises the mass spectral analysis method provided in FIG. 1. The mass spectral analysis method of FIG. 1 comprises isolation of a precursor ion in a quadrupole ion trap, direction of the ions through multipole-1 into multipole-0 where at least a portion of the precursor ions are fragmented to produce product ions, re-injection of the precursor and product ions through multipole-1 and into the quadrupole ion trap for mass analysis. The mass spectral analysis method can be carried out on an instrument comprising the ion optical elements shown in FIG. 1, FIG. 2, and/or FIG. 3. The mass spectral analysis methods described herein can be practiced using the ion optical elements and related voltages provided in FIG. 4 (*a*) for cation activation and/or precursor ion dissociation and FIG. 4 (*b*) for re-injection of the resulting precursor and product ions.

Figure 8:
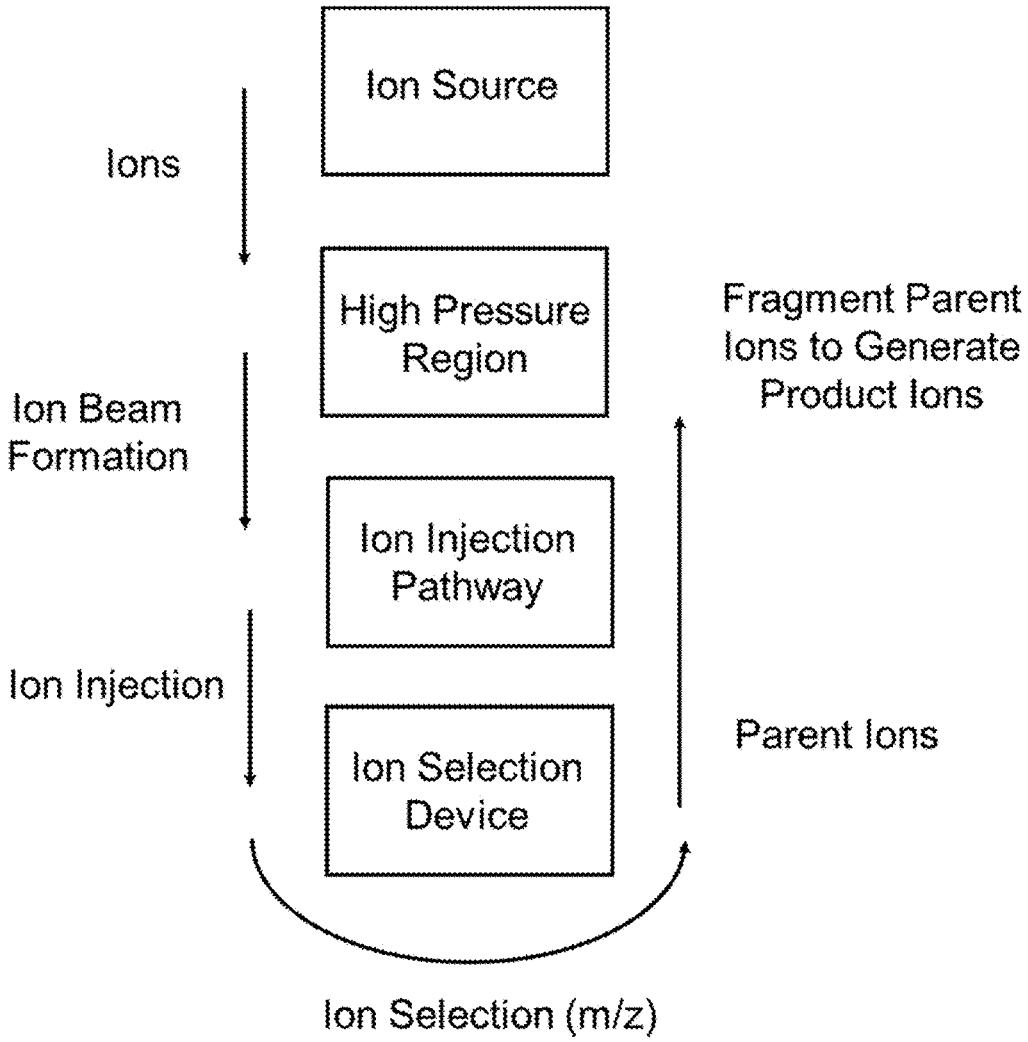
FIG. 8 provides a flow diagram for a primary inlet ion fragmentation method.
Figure 9:
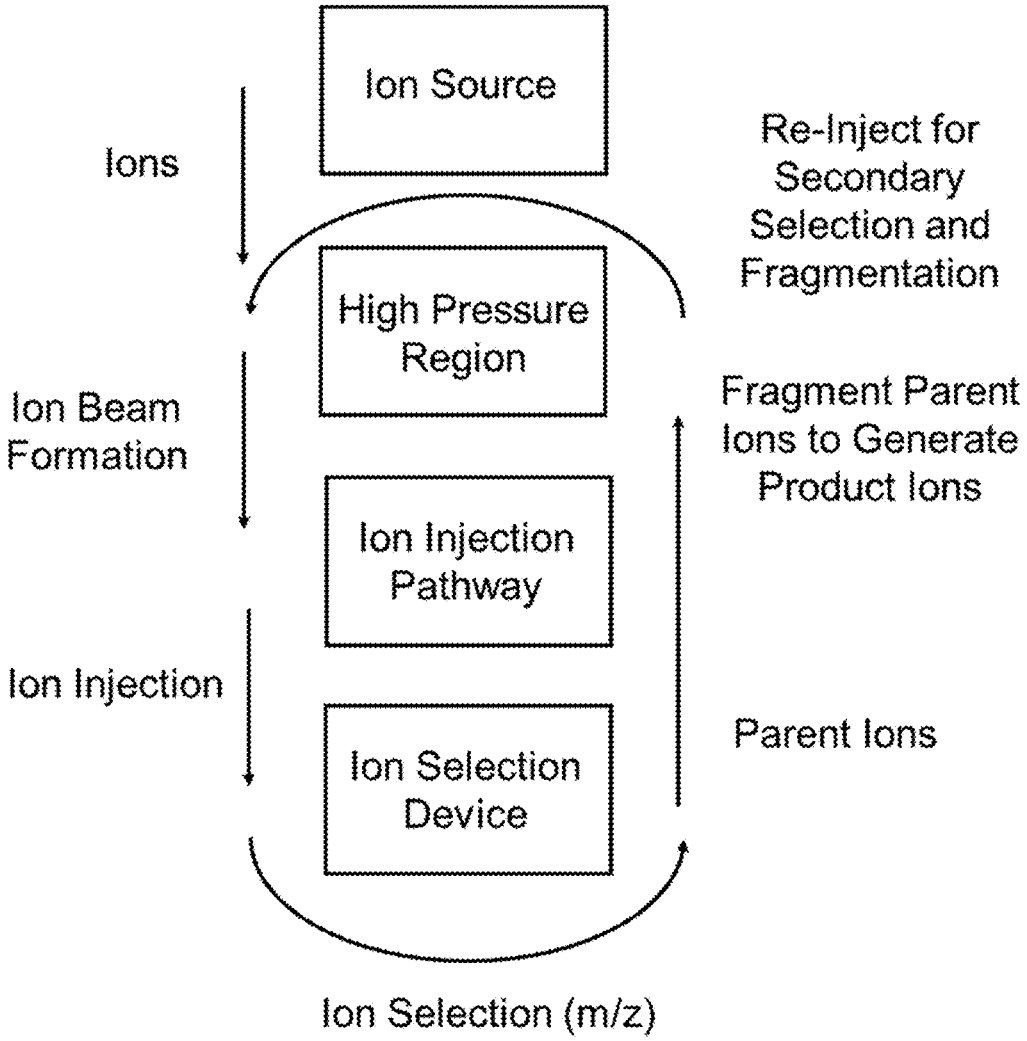
FIG. 9 provides a flow diagram for a secondary and higher inlet ion fragmentation method.
Figure 10:
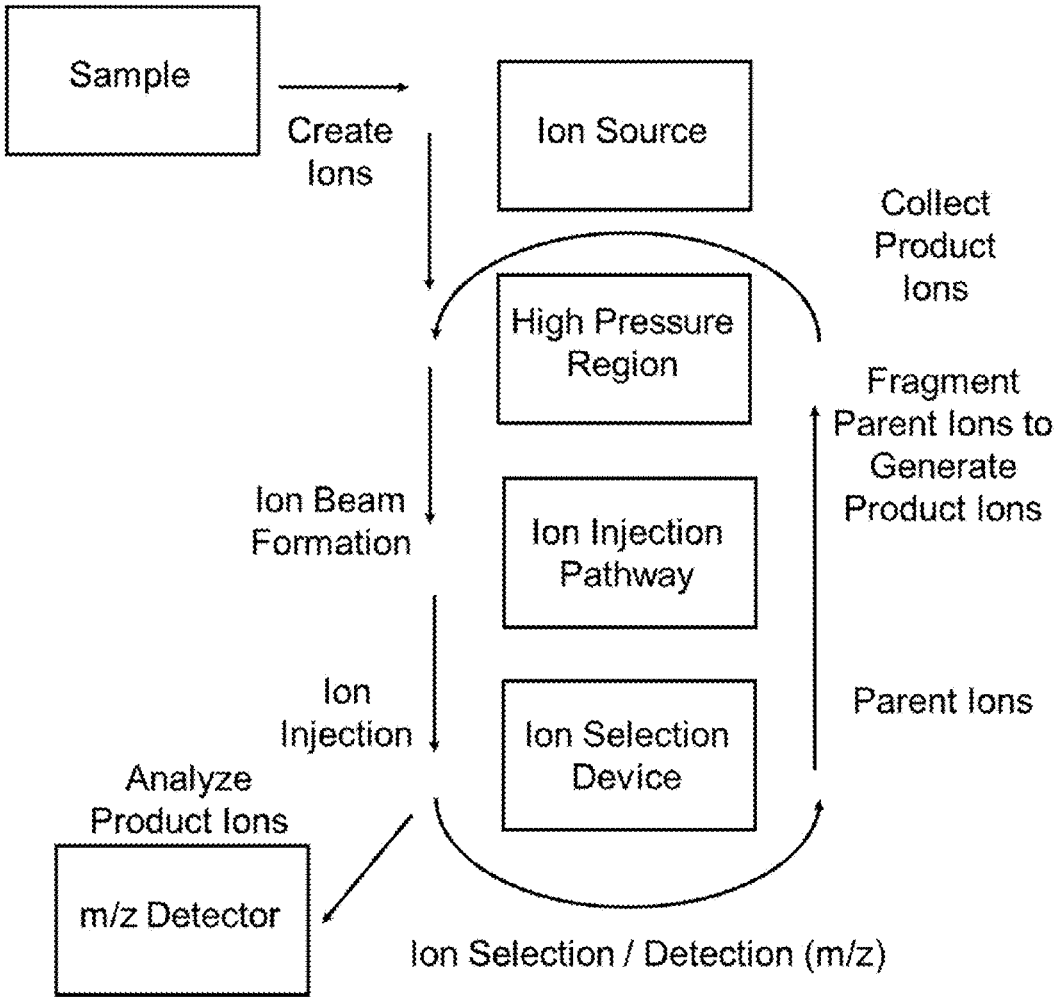
FIG. 10 provides a flow diagram for a mass spectrometry inlet ion fragmentation sample analysis method.

In a further embodiment, the invention comprises the ion fragmentation method depicted in FIG. 8, comprising producing precursor ions in an ion source, passing the precursor ions through an inlet into an ion injection pathway to form a beam of precursor ions, injecting the precursor ions into an ion selection device, selecting a subset of the precursor ions with the ion selection device to form a beam of parent ions, directing the parent ions back towards the inlet into the ion injection pathway, and fragmenting at least of a portion of the parent ions to generate product ions. In an aspect of this embodiment depicted in FIG. 9, the product ions are re-injected into the ion selection device for further ion selection and optionally further fragmentation. In another aspect of this embodiment depicted in FIG. 10, the product ions are re-injected into the ion selection device for analysis of the mass-to-charge ratios of the product ions which can optionally include the use of a mass-to-charge (m/z) detector to detect the mass-to-charge ratios of the product ions.

EXAMPLE 1

Figure 5:
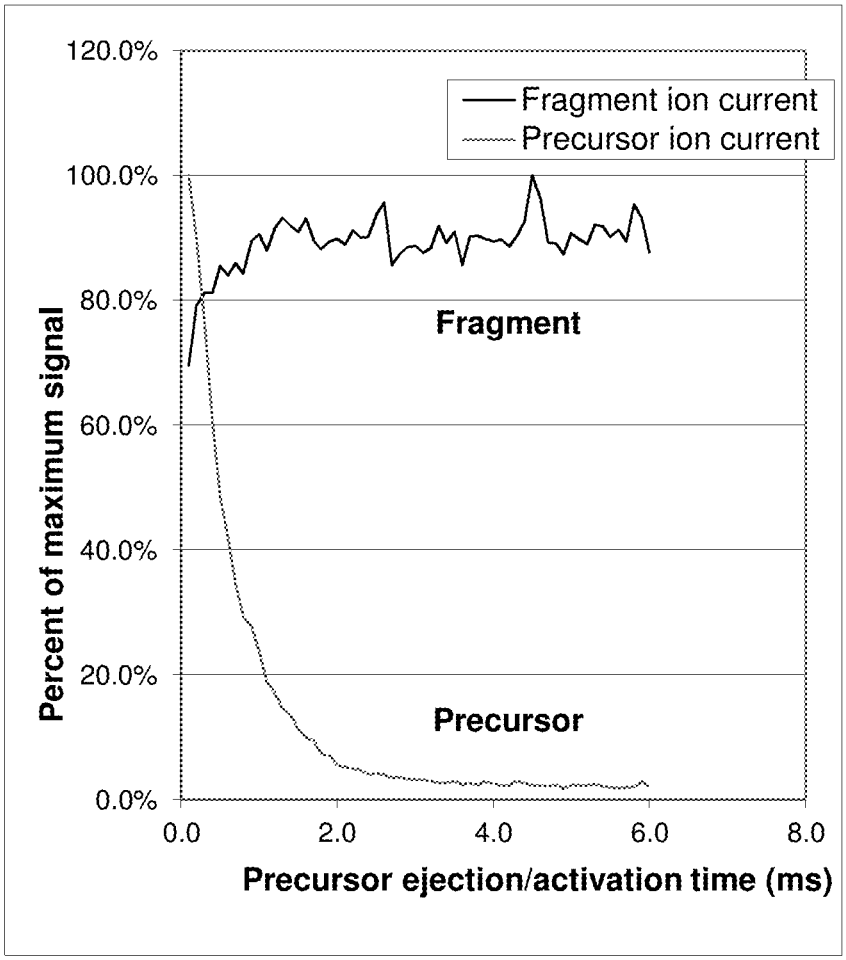
FIG. 5 provides a plot of percent of maximum signal as a function of precursor ejection/activation time for fragment ion current and precursor ion current.
Figure 6:
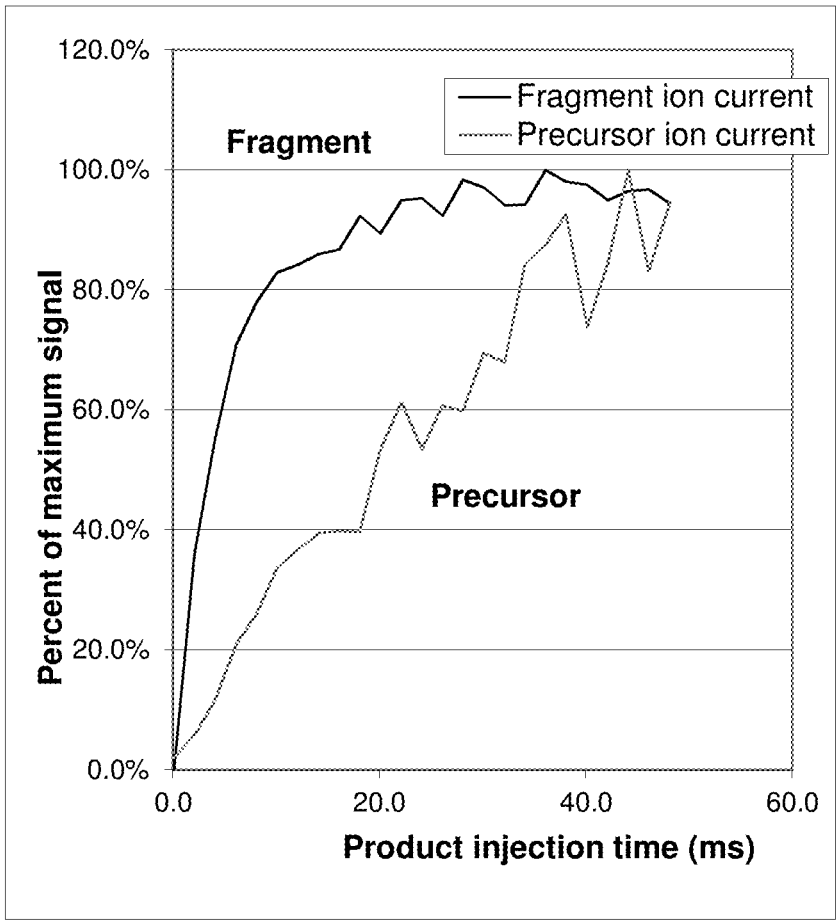
FIG. 6 provides a plot of percent of maximum signal as a function of product ion injection time for fragment ion current and precursor ion current.
Figure 7:
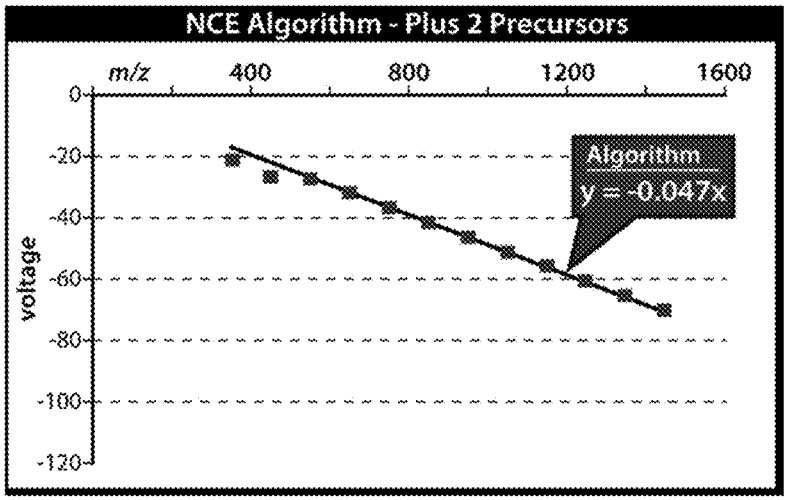
FIG. 7 provides a correlation plot for determining the voltage on multipole-0 of FIGS. 2-4 as a function of mass-to-charge ratio for (a) precursor ions having a +2 charge and (b) precursor ions having a +3 charge. The correlation between voltage on multipole-0 of FIGS. 2-4 (y) and precursor mass-to-charge ratio (x) is displayed in the call out box in panel (a) and panel (b).
Figure 7:
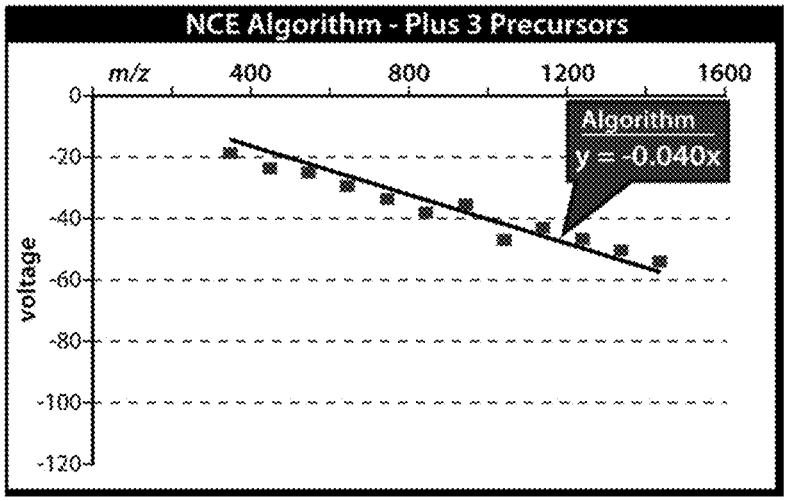

Experimental Details Related to Spectra Presented in FIGS. 5, 6, and 7

FIGS. 5 and 6 provide examples of correlation plots collected during the optimization of the methods described herein. In these experiments, triply charged Angiotensin (Sigma-Aldrich) cations were interrogated using a linear quadrupole ion trap mass spectrometer (LTQ, Thermo Fisher Scientific). First, precursor cations were formed at the ion source via electrospray ionization. Next, the ions were passed through the ion injection pathway into the linear quadrupole ion trap. The Angiotensin cations were then isolated in the linear quadrupole ion trap, and the isolated population was injected back into the ion injection pathway with approximately 22 eV. The time allotted for the ions to travel along the pathway, fragment by collisions with neutral gas molecules, and to be trapped was varied. The correlation between precursor ion current and total fragment ion current was recorded as a function of this time, as shown in FIG. 5. Product ions were then re-injected along the pathway into the linear quadruple ion trap. The correlation between precursor ion current, total fragment ion current and the time allotted for the re-injection was also recorded and is presented in FIG. 6.

FIG. 7 depicts the correlation between optimal collision energy and precursor ion mass and charge state. As the mass and charge state of the precursor varies, so does the optimal activation energy. Similar trends have been described for other collision induced dissociation methods. Here, the correlation depicted in FIG. 7 specifically describes the optimal voltage offset between the ion selection device and the first multipole (multipole 0).

EXAMPLE 2

Figure 11:
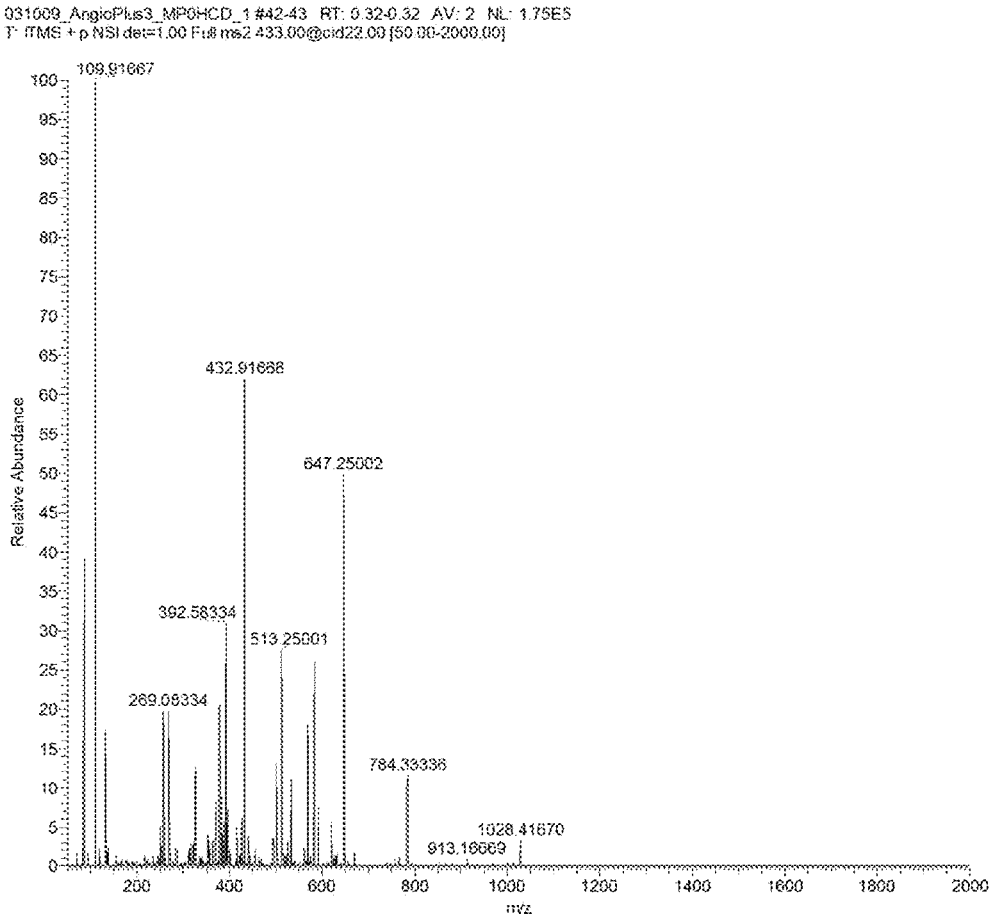
FIG. 11 provides a mass spectrum of triply charged Angiotensin using an inlet fragmentation method.
Figure 12:
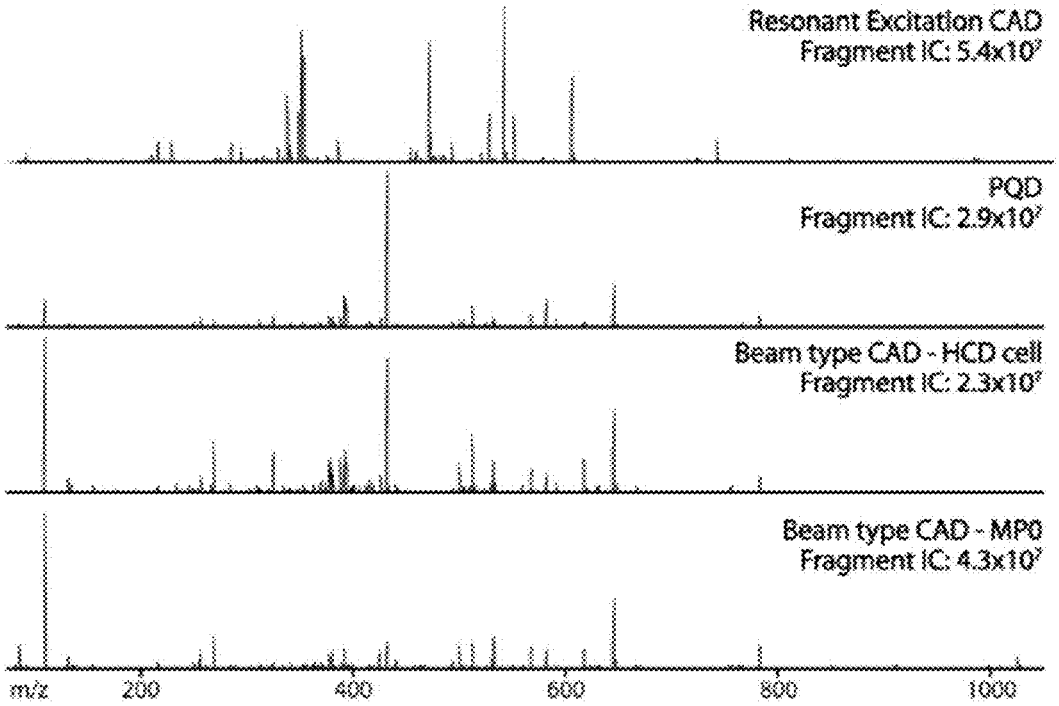
FIG. 12 provides a comparison of MS/MS mass spectra of triply charged Angiotensin for four fragmentation techniques.
Figure 13:
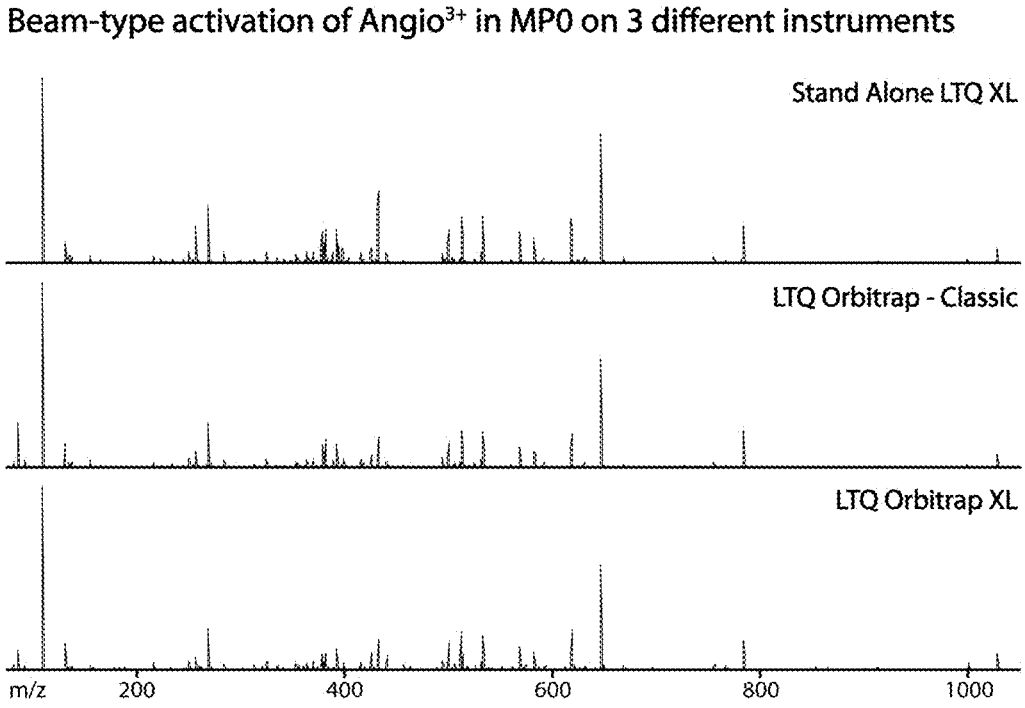
FIG. 13 provides a comparison of triply charged Angiotensin mass spectra taken using an inlet fragmentation method performed on three different instruments.

Experimental Details Related to Data Presented in FIGS. 11-13

FIGS. 11, 12 and 13 provide mass spectra showing triply charged Angiotensin (Sigma-Aldrich) cations interrogated using a range of mass spectrometers and dissociation methods. In every case, precursor cations were formed at the ion source via electrospray ionization and then injected into a linear quadrupole ion trap through an ion injection pathway. Next, the triply charged Angiotensin cations were selected in the linear quadrupole ion trap. In FIG. 11, the precursor cations were then transmitted back along the injection pathway at a high relative kinetic energy (22 eV). During this transmission they collided with background gas molecules, which ultimately resulted in fragmentation. Following fragmentation, the resulting product ions and the remaining precursor ions were re-injected into the linear quadrupole ion trap. FIG. 12 shows the same precursor ions interrogated using resonant excitation CAD (CAD), pulsed-Q dissociation (PQD), a standard beam-type method that employs a dedicated collision-cell (HCD), and our method that utilizes the pre-existing ion injection pathway (MP0). Note, that the spectrum collected using our method and the spectrum collected using the method that employs a dedicated collision-cell look quite similar, that is, the distribution of fragment ions is similar between the two spectra. Also, note how compared to the two methods that employ resonant excitation, the formation and capture efficiency of low m/z ions is much higher with our method. Finally, FIG. 13 provides three spectra that were collected on three different instruments (a standalone LTQ, an LTQ-Orbitrap classic, and a LTQ-Orbitrap XL) all using our method. In spite of the different instrument configurations, our method is capable of producing beam-type CAD spectra.

EXAMPLE 3

Figure 14:
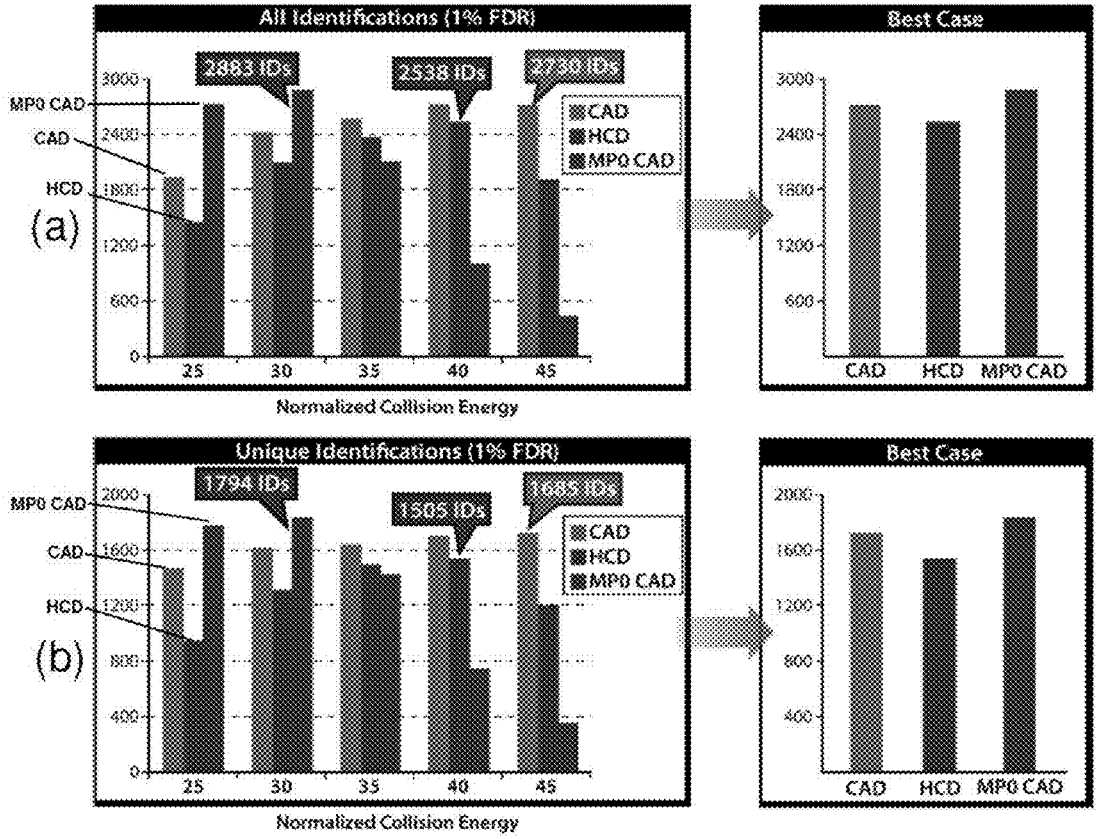
FIG. 14 provides (a) all identification data and (b) unique identification data as a function of normalized collision energy using three different fragmentation methods for a yeast whole-cell lysate enzymatically digested with LysC.
Figure 15:
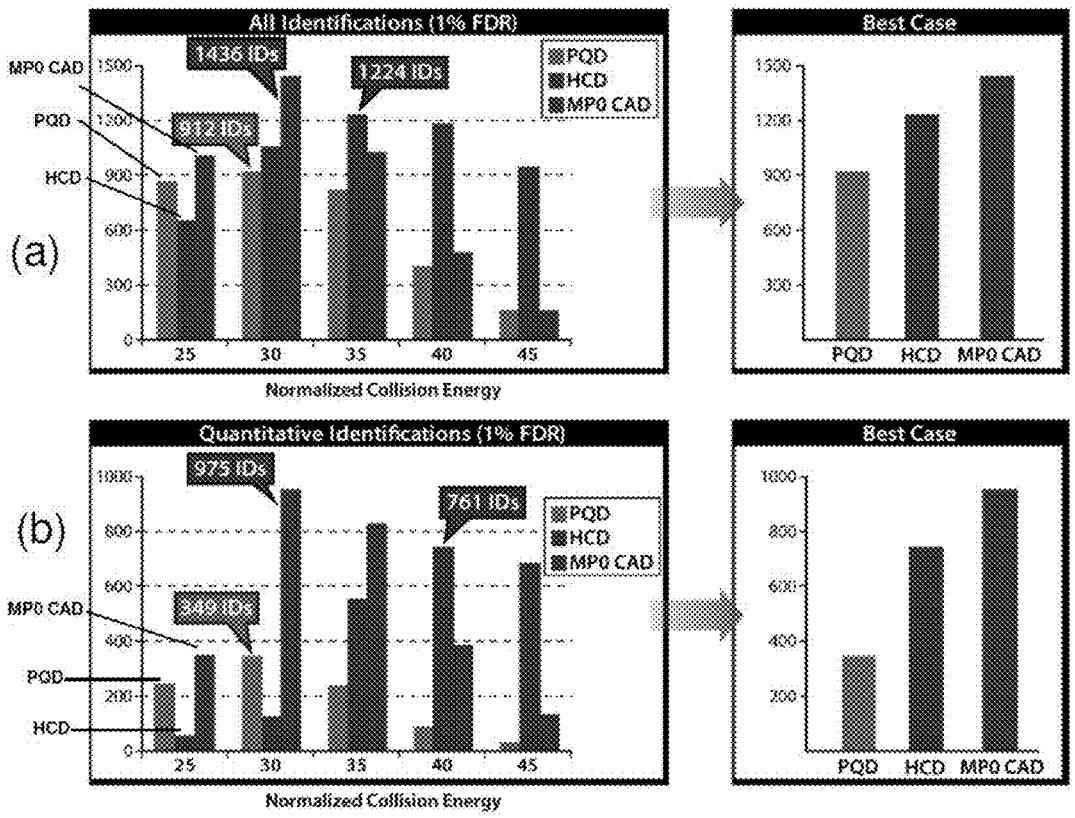
FIG. 15 provides (a) all identification data and (b) quantitative identification data as a function of normalized collision energy using three different fragmentation methods for a human embryonic stem cell lysate enzymatically digested using LysC and labeled using isobaric tags for relative quantitation (iTRAQ, Applied Biosystems).

Experimental Details Related to Data Presented in FIGS. 14-15

In FIGS. 14 and 15 we present the results from a series of LC-MS/MS analyses that utilized our method, as well as three other typical fragmentation methods. In the first comparison (FIG. 14), we analyzed a yeast whole-cell lysate that had been enzymatically digested with LysC. In 15 separate LC-MS/MS analyses, the sample was interrogated using the standard resonant-excitation fragmentation method (CAD), the standard collision cell based beam-type fragmentation method (HCD), and our beam-type fragmentation method (MP0 CAD). The normalized collision energy was also varied using the prescribed algorithm for each fragmentation method, that is, CAD and HCD utilized the vendor-supplied algorithms, while for our method we utilized the algorithm presented in FIG. 7. At the optimal normalized collision energies for all three algorithms, our method (MP0 CAD) produced more peptide spectral matches, as shown in FIG. 14 Panel A, and more unique peptide sequence identifications, as shown in FIG. 14 Panel B.

FIG. 15 depicts a similar set of experiments, but in this case we analyzed a human embryonic stem cell lysate that was enzymatically digested using LysC and then labeled using isobaric tags for relative quantitation (iTRAQ, Applied Biosystems). Instead of utilizing CAD, which cannot retain the quantitative reporter ions, we substituted in pulsed-Q dissociation (PQD). Of the three fragmentation methods (PQD, HDC and MP0 CAD), our method produced more unique peptide sequence identifications as well as more quantitative identifications. That is, on average the spectra produced by our method had more intense reporter ions than spectra produced by the other two methods.

EXAMPLE 4

Figure 16:
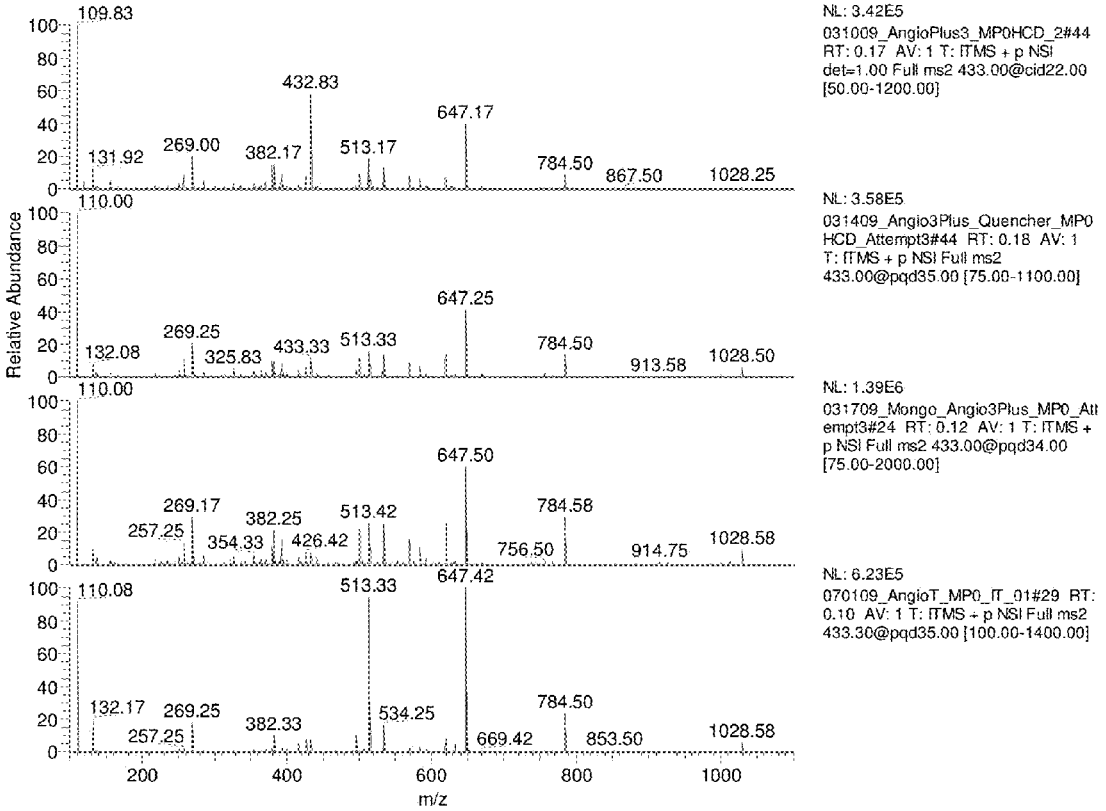
FIG. 16 provides mass spectra of triply charged Angiotensin using a fragmentation method described herein.

Experimental Details Related to Data Presented in FIG. 16

FIG. 16 provides spectra in which triply charged Angiotensin (Sigma-Aldrich) cations were interrogated in back-to-back analyses. In every case, precursor cations were formed at the ion source via electrospray ionization and then injected into a linear quadrupole ion trap through an ion injection pathway. Next, the triply charged precursor cations were selected in the linear quadrupole ion trap, and then transmitted back along the ion injection pathway at a high relative kinetic energy (22 eV). During this transmission they collided with background gas molecules that resulted in fragmentation. Following fragmentation the resulting product ions and remaining precursor ions were re-injected into the linear quadrupole ion trap, where they were m/z analyzed. Note the reproducibility of the resulting product ion mixture in back-to-back analyses.

EXAMPLE 5

Optimization Methods

In an effort to reduce the costs of quadrupole mass filter based mass spectrometers, a single RF voltage is typically applied across multipole quadrupolar electrode arrays. In many applications, this means the same RF voltage is applied to Q0 and Q1. In related applications, a fraction of the main RF voltage that is applied to the mass-resolving quadrupole (Q1) is applied to the transmission quadrupole (Q0) by placing capacitors between the electrode arrays. Dividing down the voltage between Q1 and Q0 can be advantageous because often the amplitude of the main RF voltage can be set quite high, such that if it were also applied to a quadrupole that was at higher pressure (i.e., Q0) then the voltage may arc across the rods. In either case, in these applications the voltage applied to the transmission quadrupole is dependent upon the voltage applied to the mass-resolving quadrupole. That is, the transmission quadrupole and mass-resolving quadrupole are not under independent control.

An unfortunate reality of quadrupolar electric fields is that, depending upon the application, different voltages are required. Hence, a significant drawback to coupling a voltage across multipole electrode assemblies is that the ability to perform different functions in different arrays simultaneously is lost. FIGS. 17-20 demonstrate what would happen if one attempted to dissociate ions in Q0, while the RF voltage applied to Q0 was still coupled to Q1. Unless otherwise noted, these figures were adapted from *Quadrupole Ion Trap Mass Spectrometry* by Raymond E. March and John F. Todd.

Figure 17:
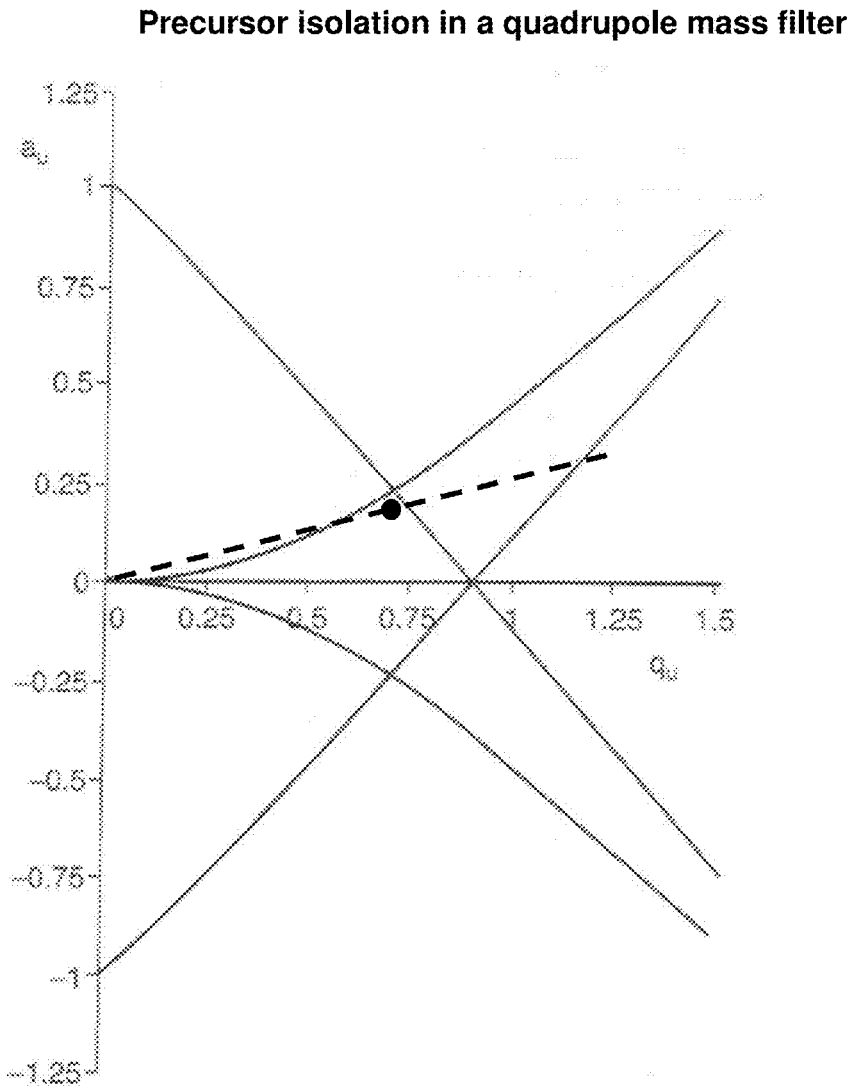
FIG. 17 provides a plot showing isolation of a precursor ion in a quadrupole mass filter wherein the differential DC and the RF amplitude are set such that the a- and q-values of the precursor place the ion at the apex of the Mathieu stability diagram.
Figure 18:
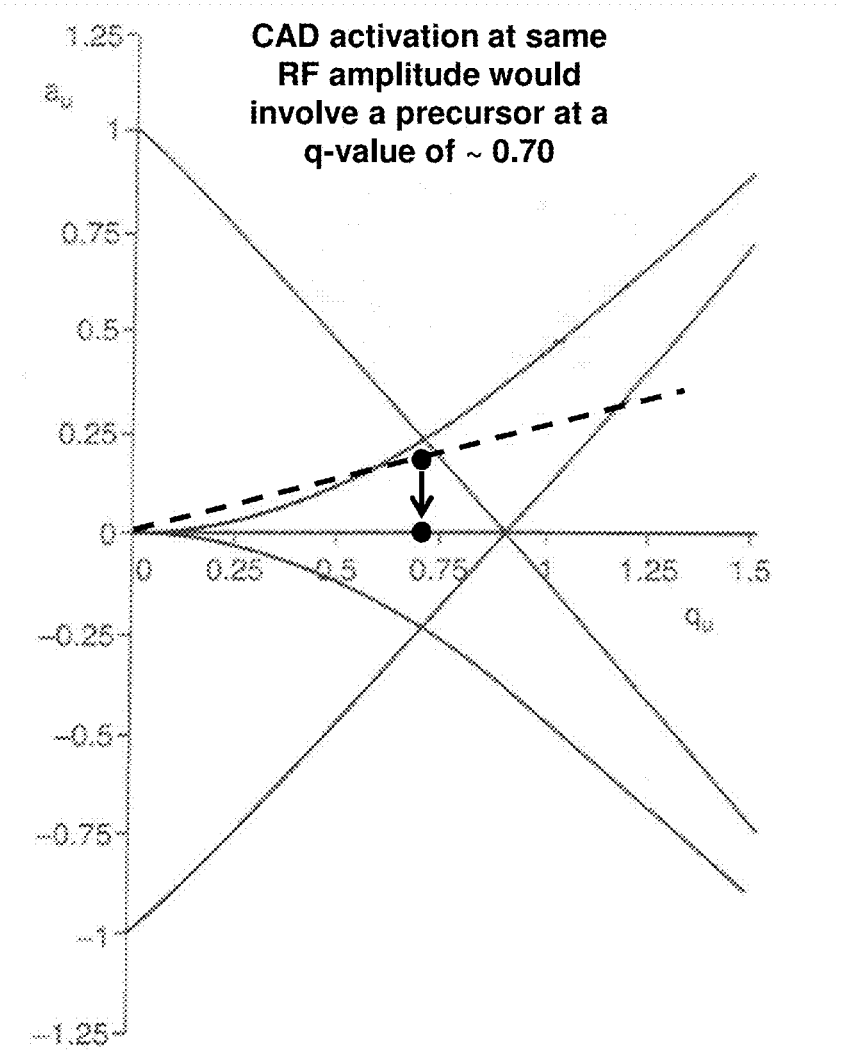
FIG. 18 provides a plot as in FIG. 17 showing that, when the RF amplitude is coupled across a first and second quadruple, the q-value of the precursor will remain constant as it is injected into the first quadruple; however, when the differential DC is removed, the a-value will go to zero as the ions move between the two quadruples.
Figure 19:
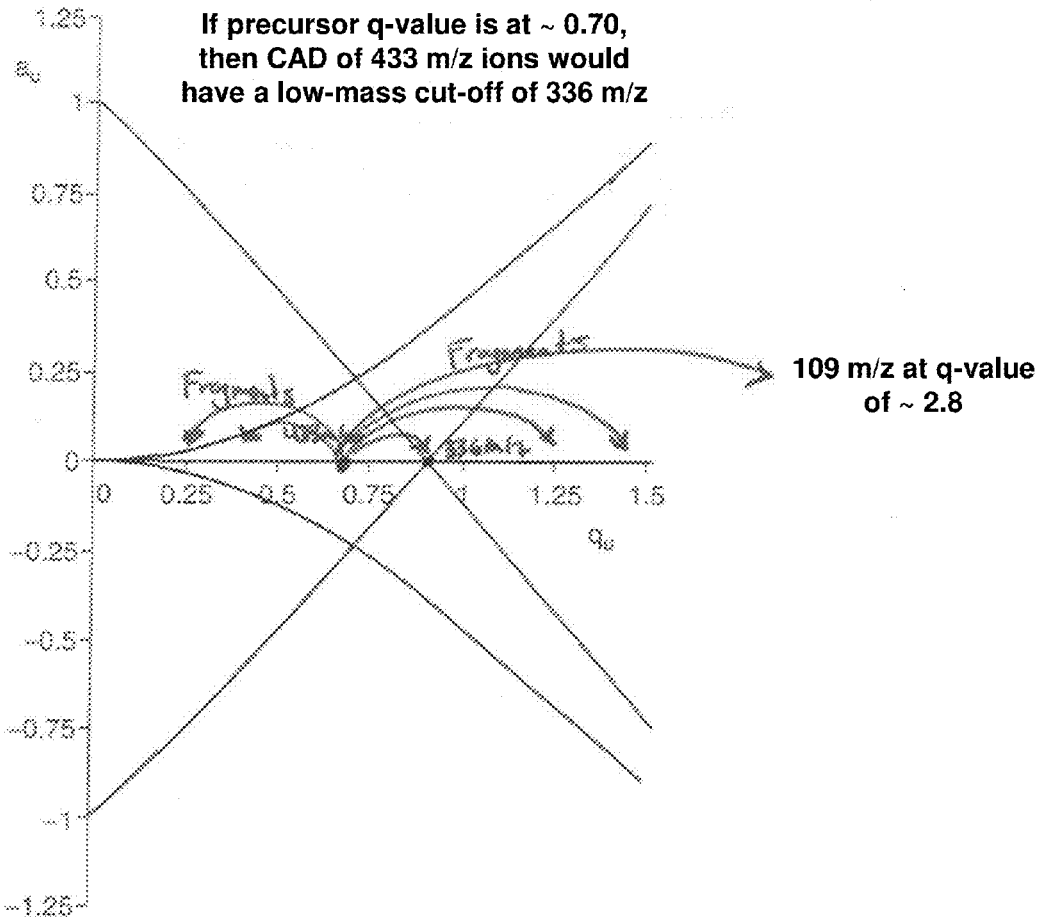
FIG. 19 provides a plot as in FIG. 17 showing that, upon CAD, the precursor will break up into a series of product ions that cover a wide range of m/z values. Assuming the q-value from isolation has been carried through to activation, a very large portion of the product ions will fall beneath the high low-mass cutoff imposed by the large RF amplitude.
Figure 20:
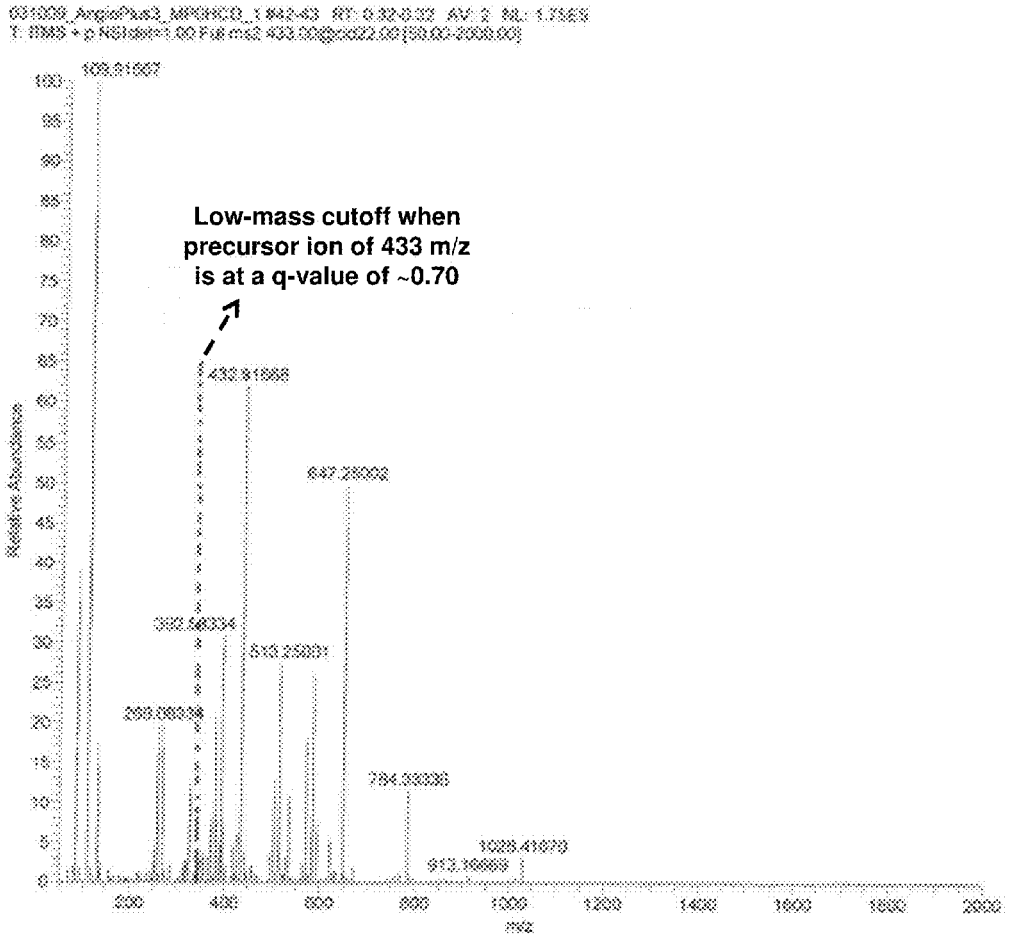
FIG. 20 provides a mass spectrum produced using a beam-type CAD method as described herein. The dotted line in the spectrum highlights the position of the theoretical low-mass cutoff if the q-value were higher due to it being fixed by the isolation step as shown in FIG. 19.

During isolation of a precursor ion in a quadrupole mass filter, the differential DC and the RF amplitude are set such that the a- and q-values of the precursor place the ion at the apex of the Mathieu stability diagram, as shown in FIG. 17. Assuming the RF amplitude is coupled across Q0 and Q1, the q-value of the precursor will remain constant as it is injected into Q0. However, the differential DC will be removed and, therefore, the a-value will go to zero as the ions move between the two electrode arrays, as shown in FIG. 18. Unfortunately, this arrangement will result in a q-value that is much too high to work effectively with collisionally activated dissociation (CAD). Upon CAD the precursor will break up into a series of product ions that cover a wide range of mass-to-charge (m/z) values. Assuming the q-value from isolation has been carried through to activation, a very large portion of the product ions will fall beneath the low-mass cutoff imposed by the large RF amplitude, which occurs at relatively high mass for this q-value, as shown in FIG. 19. FIG. 20 provides a mass spectrum produced using the beam-type CAD technique as described herein. The theoretical low-mass cutoff if the q-value were higher due to it being fixed by the isolation step is indicated in FIG. 20.

Figure 21:
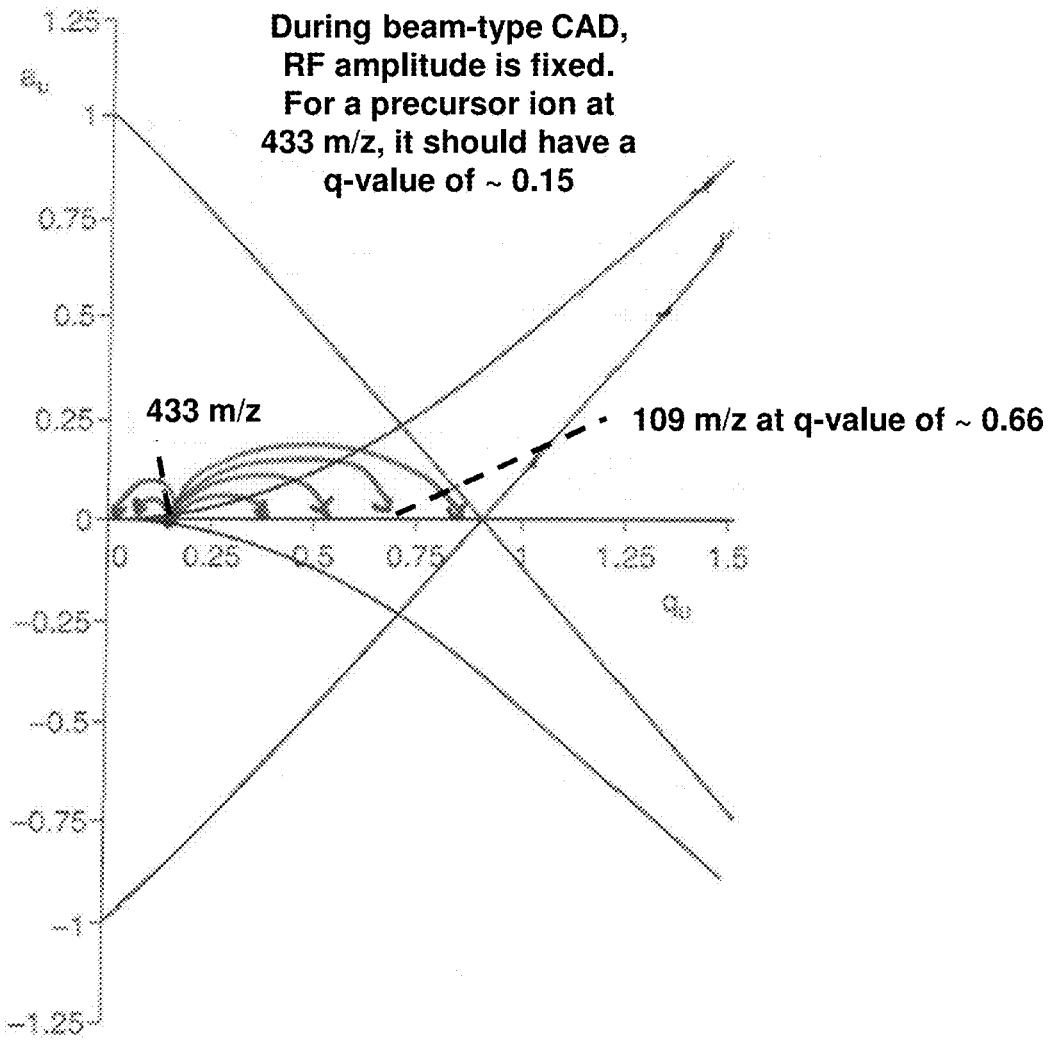
FIG. 21 provides a plot showing the much lower low-mass cutoff achieved by independent control methods as described herein.
Figure 22:
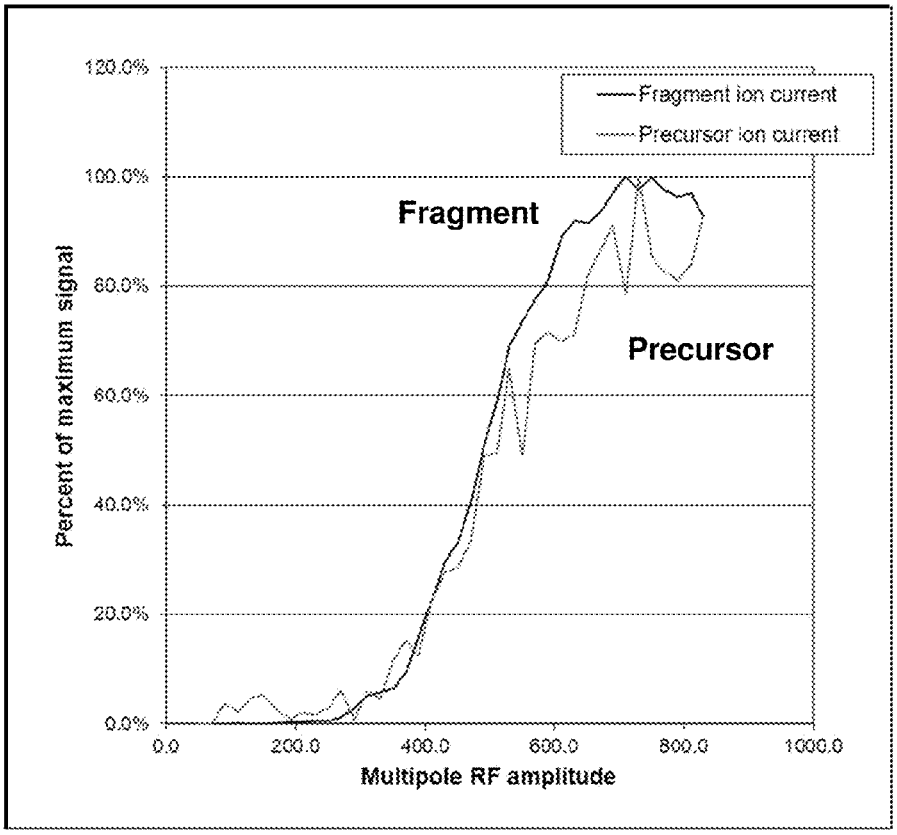
FIG. 22 provides a plot showing the Fragment and Precursor ion currents as a function of the amplitude of the RF voltage applied to the electrode arrays of the injection pathway during fragmentation of precursor ions.
Figure 23:
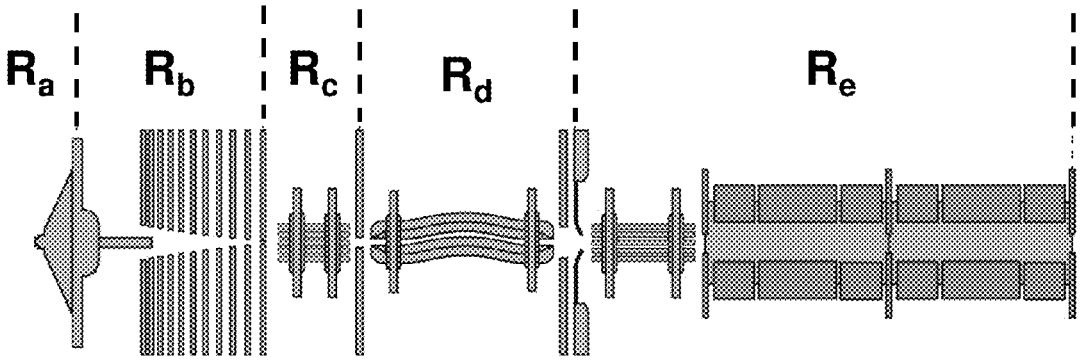
FIG. 23 provides a schematic showing a device of the invention having regions $R_a$, $R_b$, $R_c$, $R_d$, and $R_e$. Region $R_a$ generally comprises an ion source and has pressure greater than 1.5 Torr. Region $R_b$ generally comprises an ion guide and has pressure between 0.1 Torr and 10 Torr. Region $R_c$ generally comprises a multipole RF device and has pressure between $10^{-3}$ Torr and 1.5 Torr. Region $R_d$ generally comprises a multipole RF device and has pressure between $10^{-5}$ Torr and 0.1 Torr. Region $R_e$ comprises an ion selection device and optionally one or more multipole RF devices and has pressure between $10^{-7}$ Torr and $10^{-3}$ Torr.

Alternatively, the electrode array where the precursors are isolated and the electrode array of the ion injection pathway are not coupled; hence, the same RF amplitude is not applied to both sets of electrodes. As such, the RF amplitude in the ion injection pathway can be set at a value that is low enough to capture low m/z fragment ions (FIG. 21). FIG. 22 provides results of an experiment that highlights the fact that the RF amplitude of the electrode array of the ion injection pathway is independent of the RF amplitude of the electrode array where the precursors are isolated. The results provided in FIG. 22 also demonstrate some of the optimizations that went into developing the present dissociation method. In this experiment, triply charged Angiotensin cations were interrogated using the electrode array where the precursors are isolated. First, precursor cations were formed at the ion source via electrospray ionization. Next, the ions were passed through the ion injection pathway into the linear quadrupole ion trap. The Angiotensin cations were then isolated in the linear quadrupole ion trap, and the isolated population was injected back into the ion injection pathway with approximately 22 eV. The amplitude of the RF voltage applied to the electrode arrays of the injection pathway during activation of the precursor cations was varied. The correlation between precursor ion current and total fragment ion current was recorded as a function of this RF amplitude. During this experiment, the RF voltages applied during injection to the electrode array where the precursors are isolated were not changed and the remainder of the scan cycle proceeded normally. It is important to note that during routine operation of the instrument, the same RF amplitude is applied to the electrodes of the injection pathway every time a precursor ion is re-injected. Hence, the low-mass cutoff imposed by this implementation of CAD is constant, and independent of the precursor m/z.

EXAMPLE 6

Higher-Energy Collision-Activated Dissociation without a Dedicated Collision Cell High energy collision-induced dissociation (HCD) offers many advantages over resonant excitation collision-activated dissociation (CAD), including improved identification of phosphorylated peptides and compatibility with isobaric tag-based quantitation (e.g., TMT and iTRAQ). However, HCD typically requires specially designed and dedicated collision cells. Here we describe HCD that can be performed in the ion injection pathway of a mass spectrometer with a standard atmospheric inlet (iHCD). Testing this method on complex peptide mixtures revealed similar identification rates to CAD (2,883 vs. 2,730 IDs for iHCD/CAD, respectively) and precursor-product-conversion efficiency comparable to that achieved within a dedicated collision cell. Compared to pulsed-q dissociation (PQD), a quadrupole ion trap-based method that retains low-mass isobaric tag reporter ions, iHCD yielded iTRAQ reporter ions 10-fold more intense. This method involves no additional hardware and can be implemented on any mass spectrometer with an atmospheric inlet.

Introduction

Beam-type collision-activated dissociation (HCD) is the primary means to effect vibronic dissociation. The conventional approach involves energetic injection of selected precursor cations into a collision cell filled with inert gas (>1 mTorr). These dedicated collision cells are central components of numerous hybrid MS systems, e.g., Q-TOF, QqQ, Orbitrap, etc. Ion trap MS systems, however, accomplish collisional activation via resonant excitation of a trapped precursor population (ion trap CAD, which for brevity we abbreviate here as CAD). Rather than imparting one or two higher-energy collisions, as in HCD, CAD slowly heats precursor ions with hundreds of low energy collisions. The result is a slightly different product ion distribution (from HCD) which lacks low m/z products due to a low-mass cutoff imposed by the magnitude of the RF trapping field. Yet the ubiquity of ion traps has made CAD a widely used dissociation method(1); it has resulted in some of the most comprehensive proteomic analyses to date, including the identification of the entire yeast proteome and over 30,000 phosphorylation sites in mice. (2, 3)

The recent introduction of quadrupole linear ion trap (QLT) hybrids with dedicated collision cells has allowed a direct comparison of CAD to HCD.(4-7) Able to access higher-energy fragmentation channels, HCD results in more peptide identifications than CAD, particularly for phosphorylated peptides.(4, 8) Beyond that, HCD offers a number of advantages. First, HCD is not subject to the low-mass cutoff inherent to CAD, and is therefore compatible with isobaric tagging strategies for multiplexed quantitation (e.g., iTRAQ and TMT).(9-11) Second, acquisition of collision-based dissociation spectra in a standard form can greatly facilitate cross-platform comparison and data transferability. For example, downstream selected reaction monitoring (SRM) experiments, which utilize HCD (i.e., QqQ), depend on prior knowledge of precursor-to-product transitions from upstream discovery data.(12, 13) Third, HCD generates immonium ions, and other secondary fragments, which can aid both sequence determination and post-translational modification detection.(14)

The dedicated collision cell required to implement conventional HCD, however, increases instrument complexity and cost, especially for standalone QLT systems. Here we disclose that HCD can be performed both efficiently and quickly in the pre-existing atmospheric inlet region (inlet HCD or iHCD). iHCD requires no hardware modification and brings HCD capability to any MS system having an atmospheric pressure (AP) inlet. Typical MS operation, of course, involves ion transmission from an AP inlet to a mass analyzer, a QLT in this Example 6, using a collection of electrostatic and electrodynamic ion optics and quadrupole ion guides.(15) These elements pass ions through differentially pumped vacuum regions, the high pressure sections (>1 mTorr) of which can provide an in situ collision cell. Following injection and isolation, the resulting precursor population can be transmitted back along the ion injection pathway with kinetic energy sufficient to induce dissociation. The products of these collisions, which are trapped in that space, can be either injected into the primary mass analyzer (e.g., QLT) or sent on to a secondary analyzer (e.g., orbitrap).(16, 17)

Tandem mass spectra acquired using iHCD are highly similar to MS/MS spectra acquired with a dedicated collision cell. Comparisons to existing methods revealed that iHCD identified as many or more peptides than CAD, pulsed-Q dissociation (PQD), or HCD. iHCD is robust, sensitive, and compatible with any MS system having an AP inlet.

Experimental

Cell Growth and Lysis. Human embryonic stem cells (line H1) were maintained in a feeder independent system, as previously described.(18) Upon reaching 70% confluency, cells were passaged enzymatically using dispase (Invitrogen, Carlsbad, Calif.) at a 1:4 splitting ratio. Cells were harvested by individualizing for 10 min with an adequate volume of pre-warmed (37° C.), 0.05% TrypLE (Invitrogen, Carlsbad, Calif.) to cover the culture surface. Following cell detachment, an equivalent volume of ice-cold DPBS (Invitrogen, Carlsbad, Calif.) was added before collecting the cells. Cell pellets were subsequently washed twice in ice-cold PBS and stored at −80° C. Approximately 108 cells were collected for each analysis.

Samples were lysed via sonication in lysis buffer containing 40 mM NaCl, 50 mM tris, 2 mM MgCl2, 50 mM NaF, 50 mM b-glyceradelhyde phosphate, 1 mM sodium orthovanadate, 10 mM sodium pyrophosphate, 1 mini EDTA-free protease inhibitor (Roche Diagnostics, Indianapolis, Ind.), and 1 phosSTOP phosphatase inhibitor (Roche Diagnostics, Indianapolis, Ind.).

Digestion and iTRAQ Labeling. Cysteine residues were reduced with DTT, alkylated using iodoacetamide, and digested in a two-step process. Proteinase Lys-C (Wako Chemicals, Richmond, Va.) was added (enzyme:protein ratio=1:100) and incubated for approximately 2 hours at 37° C. in lysis buffer. Samples were then diluted with 50 mM tris pH until the urea concentration was 1.5 M and digested with trypsin (Promega, Madison, Wi) (enzyme:protein ratio=1:50) at 37° C. overnight. Reactions were quenched using trifluoroacetic acid (TFA). Samples were dried to completion and purified using C18 solid phase extraction (SPE) columns (SepPak, Waters, Milford, Mass.). iTRAQ labeling was performed according to manufacturer-supplied protocols. Once mixed, samples were dried to completion and purified by solid phase extraction (SPE).

Figure 24:
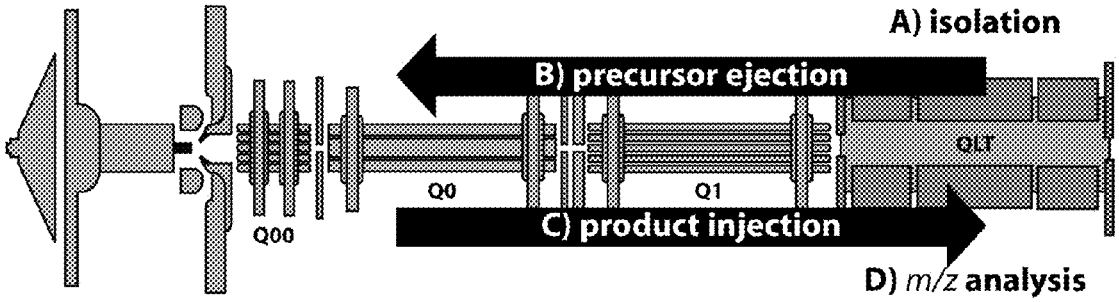
FIG. 24 provides a schematic showing an instrument diagram depicting the typical events of an iHCD scan with QLT m/z analysis. Following injection and isolation of the precursor ion population (A), precursor ions are transmitted back along the ion injection pathway with a high-degree of kinetic energy (B). As the ions pass into the higher-pressure regions located near the atmospheric pressure inlet, the ions collide with the neutral gas molecules leaking in from the AP inducing beam-type CAD. Generated products, trapped in that space, can are then injected (C) into the QLT for m/z analysis (D).

Mass Spectrometry. Experiments were performed on three systems: LTQ, LTQ-Orbitrap, and LTQ-Orbitrap XL (Thermo Fisher Scientific, San Jose, Calif.). FIG. 24 depicts the scan cycle. In brief, following injection and isolation of a particular precursor m/z peak, as shown in FIG. 24 A, the isolated precursor population is transmitted back along the ion injection pathway with a high degree of kinetic energy, as shown in FIG. 24 B. As the ions pass into the higher pressure regions, near the AP inlet, the ions collide with the neutral gas molecules leaking in from the atmospheric source. The precursor ions collide with the background gas molecules and fragment. The products are then trapped. Following fragmentation and trapping, product ions can either be further processed or mass analyzed, as shown in FIG. 24 C/D. All the associated voltages and times for this scan cycle were optimized prior to any large-scale analysis (vide infra). In these experiments, precursor ions were fragmented and the resulting products trapped in quadrupole 0 (Q0).

LC-MS/MS Analysis. LC-MS/MS analysis was performed using a NanoAcquity UPLC system (Waters, Milford, Mass.) coupled to a LTQ-orbitrap XL (Thermo Fisher Scientific, San Jose, Calif.). Peptide samples were loaded onto a pre-column (75 μm ID, packed with 5 cm C18 particles, Alltech, Deerfield, Ill.) for 10 min at a flow rate of 1 μL/min. Peptides were then eluted from a reversed-phase LC column (50 μm ID, packed with 15 cm C18 particles, Alltech, Deerfield, Ill.) with a 120 min linear gradient from 1% to 35% acetonitrile (0.2% formic acid) at a flow rate of 300 nL/min. An additional 30 min were used for column washing and equilibration. The column making procedure was previously described.(5)

$MS^1$ spectra were acquired at a resolving power of 60,000 and an AGC target of 1,000,000. Following $MS^1$ analysis, the ten most intense precursors were selected for data-dependent activation using iHCD. Precursors having either unassigned or <2 charge states were rejected. A 60 s dynamic exclusion window was employed (repeat count of 1). MS/MS AGC targets were set to 40,000.

Database search and FDR analysis. The resulting data files were searched using the Open Mass Spectrometry Search Algorithm (OMSSA) version 2.1.4.(19) Pre- and post-search processing was performed using the Coon OMSSA Proteomic Analysis Software Suite (COMPASS).(20) Data was searched against the International Protein Index (IPI; http://www.ebi.ac.uk/IPI/) human database version 3.57, which had been concatenated with a reversed version of the same database.(21) Full enzymatic specificity was required, allowing up to 3 missed cleavages. Carbamidomethylation of cysteines, iTRAQ 4-plex on the N-terminus, and iTRAQ 4-plex on lysines were set as fixed modifications, while oxidation of methionines and iTRAQ 4-plex on tyrosines were set as variable modifications. An average mass tolerance of ±4.5 Da was used for the precursor, while a monoisotopic mass tolerance of ±0.5 Da was used for fragments ions. The resulting peptide spectral matches were trimmed to a 1% FDR using both e-value and precursor mass accuracy.(22) Peptides were grouped into proteins following the rules previously established.(23) P-scores for unique peptides that were grouped together by a common protein were multiplied to obtain the protein P-Scores. Proteins were filtered by this score to achieve a 1% FDR.

Figure 25:
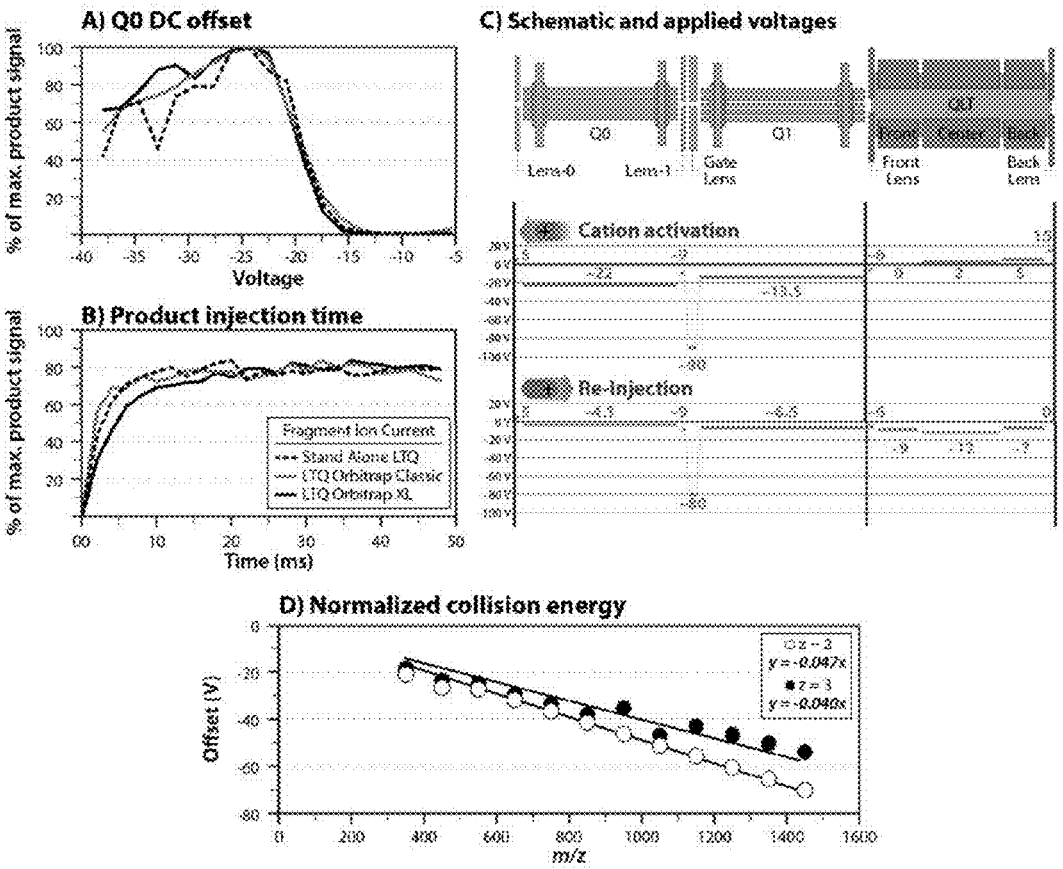
FIG. 25 provides a schematic showing iHCD parametric evaluation. Panel A presents the relationship between the maximum product ion signal and the voltage offset between Q0 and the QLT. Panel B displays the time required for the ejection of product ions out of Q0 and into the QLT. As judged by data from three platforms, a standalone LTQ, an LTQ-Orbitrap Classic, and an LTQ-Orbitrap XL, the optimal conditions are identical. A schematic overview of the conditions necessary to effect iHCD on triply protonated angiotensin ions is presented in panel C. Finally, plots relating the optimal offset voltages between Q0 and the QLT (i.e., the optimal collision energy) for producing a sequence informative MS/MS spectrum as a function of precursor m/z and charge state are shown in D.

Results and Discussion iHCD Implementation. As shown in FIG. 24, iHCD was implement in Q0, which operated at a pressure comparable to dedicated collision cells (~1-5 mTorr). The iHCD scan cycle involves four major steps: (A) injection and isolation of selected precursor m/z peak (QLT), (B) activation in the high pressure region near the AP inlet (Q0), (C) injection of product ions into the system for further processing (e.g., product isolation, ion/ion reaction, etc.) and/or (D) m/z analysis in either the primary or secondary analyzer, if present (e.g., QLT or orbitrap, respectively). For maximum sensitivity steps B and C required extensive optimization (i.e., high precursor-to-product conversion efficiency). Initial evaluation of voltages and times was performed using triply charged angiotensin cations. FIG. 25 presents the results of these procedures as performed on three generations of QLT instruments (LTQ, LTQ-Orbitrap and LTQ-Orbitrap XL). Panel A of FIG. 25 details one such analysis: here the product ion current produced upon iHCD of triply protonated angiotensin cations was measured as a function of the voltage offset between the QLT and Q0. To achieve optimal results one must balance low transmission efficiency, at low voltage offsets, and ion loss, due to scattering at high offsets. A 22 V offset was optimal for this triply charged precursor. Such an offset imparts ~66 eV of kinetic energy, a comparable amount to that used in a dedicated collision cell. Panel B of FIG. 25 depicts a similar experiment in which the ejection of product ions from Q0 to the QLT was monitored. At short times, not all of the product ions trapped in Q0 are not ejected; however, as the time is extended to 20 ms most product ions are effectively ejected. This extended ejection time is expected as Q0 is 85 mm long and has no axial gradient. Panel C of FIG. 25 shows the optimal voltages (all ion optics) for the interrogation of triply charged cations at m/z 433. With these conditions we estimate the overall precursor-to-product conversion efficiency of iHCD at ~40%—a yield typical of collision cell HCD.

Ideal activation parameters, of course, vary with precursor charge (z) and mass (m); more specifically, the optimal voltage offset between the QLT and Q0 is precursor z and m dependent. To counter this, we developed a normalized collision energy algorithm that automatically tailors iHCD parameters to precursor characteristics. To generate the algorithm we repeatedly interrogated a yeast whole-cell lysate that was enzymatically digested with LysC by nLC-MS/MS. During each experiment we varied one instrument parameter (e.g., the voltage offset between Q0 and the QLT), producing over 20,000 peptide spectral matches (PSMs). Next, we empirically determined what instrument settings produce the most identifications for a given z and m/z range—e.g., for precursors between 300 and 400 m/z and with a charge state of 2 the offset that produced the maximal number of PSMs was ~20V, as shown in panel D, FIG. 25. This process was repeated for each m/z range to generate a line of best fit. The trend shows an increasing amount of kinetic energy must be applied with increasing m/z. Trends very similar to those depicted in panel D have been described for other collision-activated dissociation methods.(24-29) We then incorporated the normalized collision energy algorithm into the instrument control code to automatically calculate optimal iHCD voltage offsets for any selected precursor.

Figure 26:
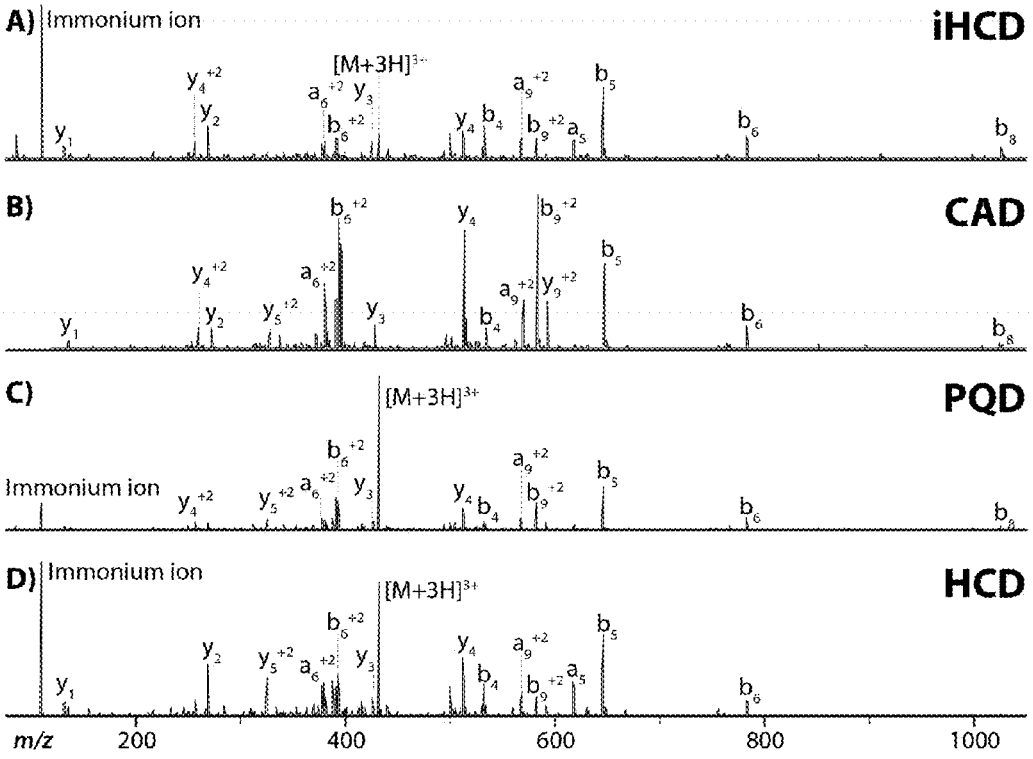
FIG. 26 provides plots showing MS/MS spectra resulting from iHCD (A), CAD (B), PQD (C), and HCD (D) of triply protonated angiotensin cations.

Comparison to Existing Fragmentation Methods. To compare iHCD to existing collision-based methods we infused angiotensin and activated the +3 precursor using CAD, PQD, HCD, and iHCD. Because they result from beam-type fragmentation, iHCD and HCD closely resemble one another, as shown in FIG. 26. For example, both display pronounced histidine immonium ion m/z peaks and have an appreciable amount of lower m/z secondary fragment ions, which tend to accumulate in beam-type CAD MS/MS spectra. A notable difference between iHCD and CAD is the complete absence of the histidine immonium ion (m/z 100) in the CAD spectrum, due to the inherent low mass cutoff of the QLT. PQD, a variant of CAD designed to overcome low mass cutoff, yields intermediate immonium ion levels.

Figure 27:
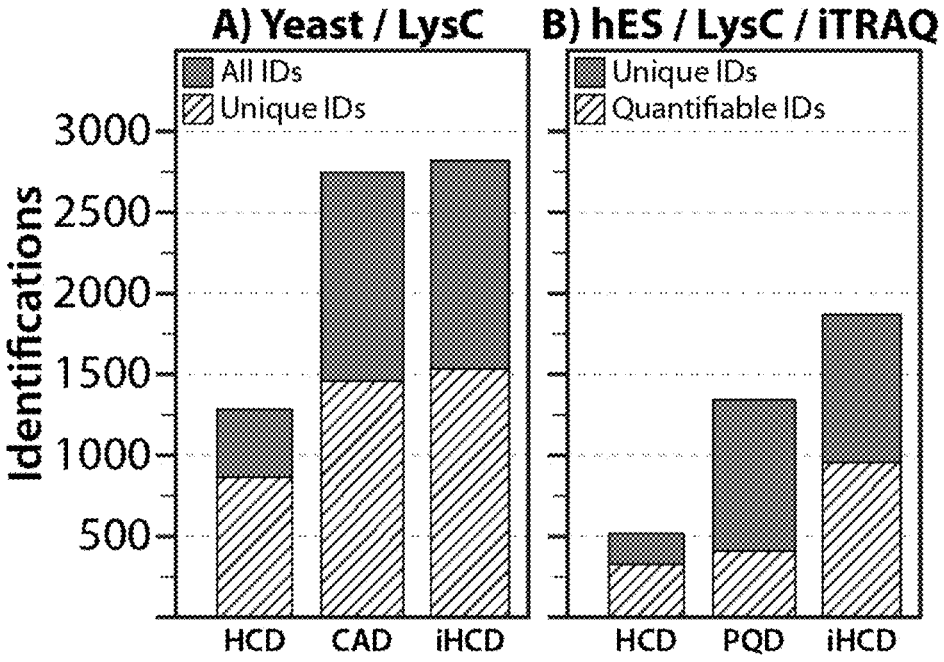
FIG. 27 provides plots showing the number of peptides identified from a yeast whole-cell lysate enzymatically digested with Lys-C and interrogated by HCD (FTMS), CAD (ITMS), and iHCD (ITMS), panel A. Panel B presents the number of peptide identifications from a human embryonic stem cell lysate that was enzymatically digested with LysC and labeled with isobaric tags (iTRAQ).

We next evaluated the ability of iHCD to identify peptides from a complex mixture (LysC digest) as compared to CAD and HCD. Under method-specific optimal conditions (e.g., preferred AGC targets, NCE values, etc.), iHCD outperformed HCD and was comparable to CAD (1% FDR, as shown in FIG. 27, panel A). We conclude this performance gap between iHCD and HCD is mainly analyzer driven. A separate comparison of iHCD to HCD using the same analyzer yielded comparable identifications (2,883 vs. 2,538 PSMs, respectively). Despite the reduced number of iHCD scans (9,556, avg. rate 280 ms vs. 9,933, avg. rate 260 ms for CAD), iHCD returned slightly more identifications (2,883 vs. 2,730). These results are typical of other comparisons we have performed (data not shown). We conclude that iHCD generates more sequence-informative MS/MS spectra than CAD.

Figure 28:
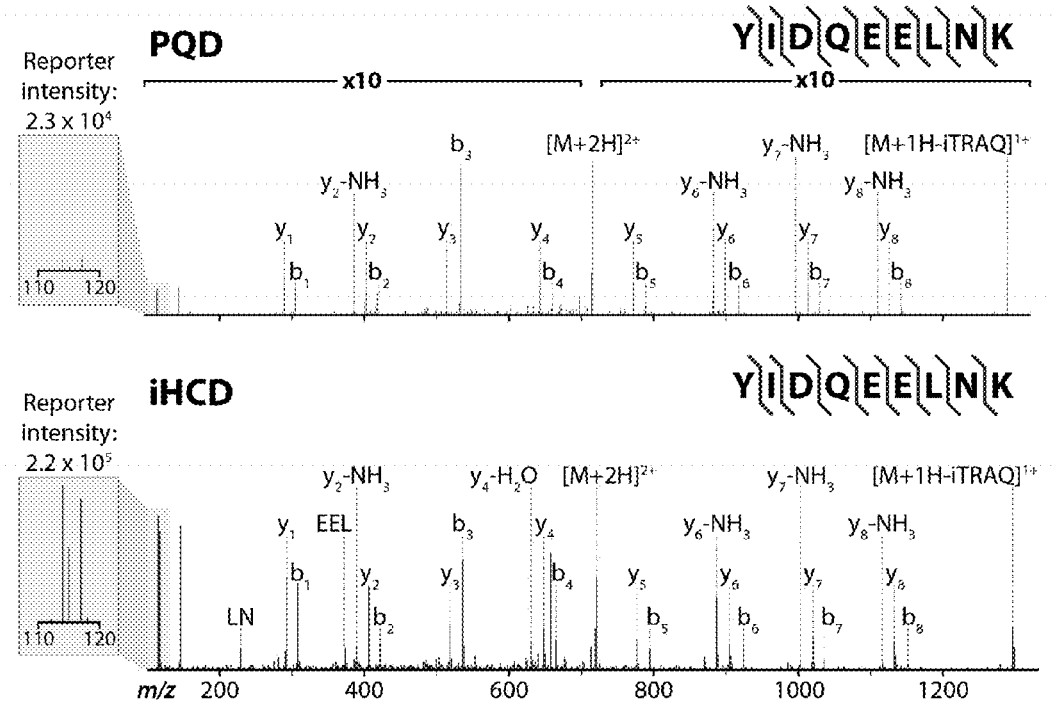
FIG. 28 provides MS/MS spectra following dissociation of an iTRAQ-labeled peptide cation interrogated using PQD and iHCD. In both cases, the resulting MS/MS spectra easily identified the corresponding peptide; however, the iTRAQ reporter ions are ~10 fold more intense in the iHCD spectrum. Additionally, secondary fragment ions are more prominent in the iHCD spectrum.

Since compatibility with isobaric tagging strategies is one of the major differences between HCD and CAD, we next sought to characterize the ability of iHCD to identify and generate quantitative information from isobarically tagged peptides (e.g., iTRAQ/TMT). iTRAQ-labeled peptides, generated from a Lys-C digest of human ES proteins, were analyzed by PQD, HCD, and iHCD. We substituted PQD for CAD, which cannot retain the quantitative reporter ions. iHCD produced more than twice as many identifications compared to either PQD or HCD, as shown in FIG. 27, panel B. As we have previously shown, reporter ion intensity directly correlates with quantitative accuracy.(4, 30) To assess the ability of iHCD to produce iTRAQ reporter ions, we performed an analysis in which both PQD and iHCD were executed on every precursor. On average, reporter ions were ~10-fold more intense when interrogated by iHCD than by PQD, as shown in FIG. 28. iHCD and HCD generate comparable amounts of iTRAQ reporter signal. Taken together, these identification and quantification data indicate that iHCD is an excellent method for isobaric tag-based quantification.

CONCLUSION

We present a method for performing HCD in the mass spectrometer AP inlet region (iHCD). iHCD provides similar or better rates of identification compared to CAD and carries with it all the benefits associated with beam-type dissociation: (1) compatibility with isobaric tags for multiplexed quantitation, (2) direct transferability of precursor-to-product transitions from discovery to targeted analysis, (3) elimination of low-mass cutoff inherent to CAD, and (4) improved sequencing capabilities, especially for PTM-containing peptides. iHCD eliminates the need for a dedicated collision cell, thereby reducing instrument complexity and cost. By doing so, iHCD brings beam-type fragmentation to virtually any MS system having an AP inlet, (e.g., ion traps, single quadrupoles, etc.). Here we describe implementation of iHCD on an LTQ quadrupole linear ion trap mass spectrometer. Recent work has extended iHCD to the newer generation dual cell QLT (Velos) with similar success.(31) This result is significant because that system's quite different AP inlet utilizes a stacked ring ion guide. In sum, iHCD is an effective, simple to implement technology that delivers beam-type CAD to any system having an AP inlet.

REFERENCES FOR EXAMPLE 6

1. Hunt D F, Buko A M, Ballard J M, Shabanowitz J and Giordani A B: (1981) Sequence-analysis of polypeptides by collision activated dissociation on a triply quadrupole mass-spectrometer. Biomedical Mass Spectrometry 8, 397-408

2. de Godoy L M F, Olsen J V, Cox J, Nielsen M L, Hubner N C, Frohlich F, Walther T C and Mann M: (2008) Comprehensive mass-spectrometry-based proteome quantification of haploid versus diploid yeast. Nature 455, 1251-U60

3. Huttlin E L, Jedrychowski M P, Elias J E, Goswami T, Rad R, Beausoleil S A, Villen J, Haas W, Sowa M E and Gygi S P: (2010) A Tissue-Specific Atlas of Mouse Protein Phosphorylation and Expression. Cell 143, 1174-1189

4. McAlister G C, Phanstiel D, Wenger C D, Lee M V and Coon J J: (2010) Analysis of Tandem Mass Spectra by FTMS for Improved Large-Scale Proteomics with Superior Protein Quantification. Analytical Chemistry 82, 316-322

5. Zhang Y, Ficarro S B, Li S J and Marto J A: (2009) Optimized Orbitrap HCD for Quantitative Analysis of Phosphopeptides. Journal of the American Society for Mass Spectrometry 20, 1425-1434

6. Olsen J V, Macek B, Lange O, Makarov A, Horning S and Mann M: (2007) Higher-energy C-trap dissociation for peptide modification analysis. Nature Methods 4, 709-712

7. Olsen J V, Schwartz J C, Griep-Raming J, Nielsen M L, Damoc E, Denisov E, Lange O, Remes P, Taylor D, Splendore M, Wouters E R, Senko M, Makarov A, Mann M and Horning S: (2009) A Dual Pressure Linear Ion Trap Orbitrap Instrument with Very High Sequencing Speed. Molecular & Cellular Proteomics 8, 2759-2769

8. Nagaraj N, D'Souza R C J, Cox J, Olsen J V and Mann M: (2010) Feasibility of Large-Scale Phosphoproteomics with Higher Energy Collisional Dissociation Fragmentation. Journal of Proteome Research 9, 6786-6794

9. Bantscheff M, Boesche M, Eberhard D, Matthieson T, Sweetman G and Kuster B: (2008) Robust and sensitive iTRAQ quantification on an LTQ orbitrap mass spectrometer. Molecular & Cellular Proteomics 7, 1702-1713

10. Ross P L, Huang Y L N, Marchese J N, Williamson B, Parker K, Hattan S, Khainovski N, Pillai S, Dey S, Daniels S, Purkayastha S, Juhasz P, Martin S, Bartlet-Jones M, He F, Jacobson A and Pappin D J: (2004) Multiplexed protein quantitation in *Saccharomyces cerevisiae* using amine-reactive isobaric tagging reagents. Molecular & Cellular Proteomics 3, 1154-1169

11. Thompson A, Schafer J, Kuhn K, Kienle S, Schwarz J, Schmidt G, Neumann T and Hamon C: (2003) Tandem mass tags: A novel quantification strategy for comparative analysis of complex protein mixtures by MS/MS. Analytical Chemistry 75, 1895-1904

12. Gerber S A, Rush J, Stemman O, Kirschner M W and Gygi S P: (2003) Absolute quantification of proteins and phosphoproteins from cell lysates by tandem MS. Proceedings of the National Academy of Sciences of the United States of America 100, 6940-6945

13. Picotti P, Rinner O, Stallmach R, Dautel F, Farrah T, Domon B, Wenschuh H and Aebersold R: (2010) High-throughput generation of selected reaction-monitoring assays for proteins and proteomes. Nature Methods 7, 43-U5

14. Falick A M, Hines W M, Medzihradszky K F, Baldwin M A and Gibson B W: (1993) Low-mass ions produced from peptides by high-energy collision-induced dissociation in tandem mass-spectrometry. Journal of the American Society for Mass Spectrometry 4, 882-893

15. Schwartz J C, Senko M W and Syka J E P: (2002) A two-dimensional quadrupole ion trap mass spectrometer. Journal of the American Society for Mass Spectrometry 13, 659-669

16. Syka J E P, Marto J A, Bai D L, Horning S, Senko M W, Schwartz J C, Ueberheide B, Garcia B, Busby S, Muratore T, Shabanowitz J and Hunt D F: (2004) Novel Linear Quadrupole Ion Trap/FT Mass Spectrometer: Performance Characterization and Use in the Comparative Analysis of Histone H3 Post-translational Modifications. Journal of Proteome Research 3, 621-626

17. Makarov A, Denisov E, Kholomeev A, Balschun W, Lange O, Strupat K and Horning S: (2006) Performance Evaluation of a Hybrid Linear Ion Trap/Orbitrap Mass Spectrometer. Analytical Chemistry 78, 2113-2120

18. Ludwig T E, Levenstein M E, Jones J M, Berggren W T, Mitchen E R, Frane J L, Crandall L J, Daigh C A, Conard K R, Piekarczyk M S, Llanas R A and Thomson J A: (2006) Derivation of human embryonic stem cells in defined conditions. Nat Biotechnol 24, 185-7

19. Geer L Y, Markey S P, Kowalak J A, Wagner L, Xu M, Maynard D M, Yang X Y, Shi W Y and Bryant S H: (2004) Open mass spectrometry search algorithm. Journal of Proteome Research 3, 958-964

20. Wenger C D, Phanstiel D H, Lee M V, Bailey D J and Coon J J: (2011) COMPASS: A suite of pre- and post-search proteomics software tools for OMSSA. Proteomics, In Press 21. Kersey P J, Duarte J, Williams A, Karavidopoulou Y, Birney E and Apweiler R: (2004) The International Protein Index: An integrated database for proteomics experiments. Proteomics 4, 1985-1988

22. Wenger C D, Phanstiel D H, Lee M V, Bailey D J and Coon J J: (2011) COMPASS: a suite of pre- and post-search proteomics software tools for OMSSA. Proteomics, n/a-n/a 23. Nesvizhskii Al and Aebersold R: (2005) Interpretation of shotgun proteomic data: the protein inference problem. Mol Cell Proteomics 4, 1419-40

24. Neta P, Simon-Manso Y, Yang X Y and Stein S E: (2009) Collisional Energy Dependence of Peptide Ion Fragmentation. Journal of the American Society for Mass Spectrometry 20, 469-476

25. Cox K A, Gaskell S J, Morris M and Whiting A: (1996) Role of the site of protonation in the low-energy decompositions of gas phase peptide ions (vol 7, pg 522, 1996). Journal of the American Society for Mass Spectrometry 7, 759-759

26. Dongre A R, Jones J L, Somogyi A and Wysocki V H: (1996) Influence of peptide composition, gas-phase basicity, and chemical modification on fragmentation efficiency: Evidence for the mobile proton model. Journal of the American Chemical Society 118, 8365-8374

27. Haller I, Mirza U A and Chait B T: (1996) Collision induced decomposition of peptides. Choice of collision parameters. Journal of the American Society for Mass Spectrometry 7, 677-681

28. Summerfield S G and Gaskell S J: (1997) Fragmentation efficiencies of peptide ions following low energy collisional activation. International Journal of Mass Spectrometry 165, 509-521

29. Wysocki V H, Tsaprailis G, Smith L L and Breci L A: (2000) Special feature: Commentary—Mobile and localized protons: a framework for understanding peptide dissociation. Journal of Mass Spectrometry 35, 1399-1406

30. Phanstiel D, Zhang Y, Marto J A and Coon J J: (2008) Peptide and protein quantification using iTRAQ with electron transfer dissociation. Journal of the American Society for Mass Spectrometry 19, 1255-1262

31. Schwartz J C: Personal Communication. Thermo Fisher Scientific, 2011.

Although the description herein contains many specifics, these should not be construed as limiting the scope of the invention, but as merely providing illustrations of some of the embodiments of the invention.

STATEMENTS REGARDING INCORPORATION BY REFERENCE AND VARIATIONS

Each reference cited herein is hereby incorporated by reference in its entirety. However, if any inconsistency arises between a cited reference and the present disclosure, the present disclosure takes precedent. Some references provided herein are incorporated by reference to provide details concerning the state of the art prior to the filing of this application, other references can be cited to provide additional or alternative device elements, additional or alternative materials, additional or alternative methods of analysis or applications of the invention. Patents and publications mentioned in the specification are indicative of the levels of skill of those skilled in the art to which the invention pertains. References cited herein are incorporated by reference herein in their entirety to indicate the state of the art as of their publication or filing date and it is intended that this information can be employed herein, if needed, to exclude specific embodiments that are in the prior art.

The terms and expressions which have been employed herein are used as terms of description and not of limitation, and there is no intention in the use of such terms and expressions of excluding any equivalents of the features shown and described or portions thereof, but it is recognized that various modifications are possible within the scope of the invention claimed. Thus, it should be understood that although the invention has been specifically disclosed by preferred embodiments, exemplary embodiments and optional features, modification and variation of the concepts herein disclosed can be resorted to by those skilled in the art, and that such modifications and variations are considered to be within the scope of this invention as defined by the appended claims. The specific embodiments provided herein are examples of useful embodiments of the invention and it will be apparent to one skilled in the art that the invention can be carried out using a large number of variations of the devices, device components, methods steps set forth in the present description. As will be obvious to one of skill in the art, methods and devices useful for the present methods can include a large number of optional composition and processing elements and steps.

One of ordinary skill in the art will appreciate that device elements, as well as materials, shapes and dimensions of device elements, as well as methods other than those specifically exemplified can be employed in the practice of the invention without resort to undue experimentation. All art-known functional equivalents, of any such materials and methods are intended to be included in this invention. The terms and expressions which have been employed are used as terms of description and not of limitation, and there is no intention that in the use of such terms and expressions of excluding any equivalents of the features shown and described or portions thereof, but it is recognized that various modifications are possible within the scope of the invention claimed. Thus, it should be understood that although the present invention has been specifically disclosed by preferred embodiments and optional features, modification and variation of the concepts herein disclosed can be resorted to by those skilled in the art, and that such modifications and variations are considered to be within the scope of this invention.

When a Markush group or other grouping is used herein, all individual members of the group and all combinations and possible subcombinations of the group are intended to be individually included in the disclosure. Every combination of components or materials described or exemplified herein can be used to practice the invention, unless otherwise stated. One of ordinary skill in the art will appreciate that methods, device elements, and materials other than those specifically exemplified can be employed in the practice of the invention without resort to undue experimentation. All art-known functional equivalents, of any such methods, device elements, and materials are intended to be included in this invention. Whenever a range is given in the specification, for example, a temperature range, a frequency range, a time range, or a composition range, all intermediate ranges and all subranges, as well as, all individual values included in the ranges given are intended to be included in the disclosure. Any one or more individual members of a range or group disclosed herein can be excluded from a claim of this invention. The invention illustratively described herein suitably can be practiced in the absence of any element or elements, limitation or limitations which is not specifically disclosed herein.

As used herein, "comprising" is synonymous with "including," "containing," or "characterized by," and is inclusive or open-ended and does not exclude additional, unrecited elements or method steps. As used herein, "consisting of" excludes any element, step, or ingredient not specified in the claim element. As used herein, "consisting essentially of" does not exclude materials or steps that do not materially affect the basic and novel characteristics of the claim. The term "comprising" is intended to be broader than the terms "consisting essentially of" and "consisting of", however, the term "comprising" as used herein in its broadest sense is intended to encompass the narrower terms "consisting essentially of" and "consisting of", thus the term "comprising" can be replaced with "consisting essentially of" to exclude steps that do not materially affect the basic and novel characteristics of the claims and "comprising" can be replaced with "consisting of" to exclude not recited claim elements.

The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed. Thus, it should be understood that although the present invention has been specifically disclosed by preferred embodiments and optional features, modification and variation of the concepts herein disclosed can be resorted to by those skilled in the art, and that such modifications and variations are considered to be within the scope of this invention as defined by the appended claims.

Although the description herein contains many specifics, these should not be construed as limiting the scope of the invention, but as merely providing illustrations of some of the embodiments of the invention.

The invention claimed is:

1. A method for generating product ions, the method comprising:

providing ions from an ion source through an inlet into an ion injection pathway having ion injection pathway ion optics;

transmitting the ions along a first direction away from the inlet through the ion injection pathway into an ion selection device having ion selection device ion optics, wherein the ion injection pathway ion optics comprise two or more multipole RF devices and one or more ion lens devices, wherein the multipole RF devices and the ion lens devices are provided between the inlet and the ion selection device and wherein at least one ion lens device is provided between adjacent multipole RF devices;

selecting a subset of the ions in the ion selection device; wherein the subset of the ions have a preselected range of mass-to-charge ratios; and transmitting the subset of the ions having the preselected range of mass-to-charge ratios along a second direction toward the inlet through the ion injection pathway;

re-injecting a portion of the subset of the ions transmitted along the second direction into the inlet or into one of the two or more multipole RF devices provided between the inlet and the ion selection device, wherein the transmitting steps and selecting steps are repeated one or more times;

wherein the ion injection pathway ion optics have an RF voltage component and a DC voltage component which are under independent control with respect to the ion selection device ion optics; and wherein at least a portion of the subset of the ions transmitted along the second direction interact with one or more gases at a pressure greater than 0.01 Torr in the inlet or ion injection pathway and undergo dissociation, thereby fragmenting at least a portion of the subset of the ions having the preselected range of mass-to-charge ratios to generate the product ions.

2. The method of claim 1, wherein the ion lens devices comprise an aperture which allows for a pressure differential to be established between a first side of the ion lens device and a second side of the ion lens device.

3. The method of claim 2, wherein the pressure differential is selected to enable beam-type collision activated dissociation, ion reaction dissociation, electron reaction dissociation, neutral reaction dissociation, or laser-induced dissociation in the inlet or ion injection pathway of the ions transmitted along the second direction.

4. The method of claim 2, wherein the pressure differential is selected over the range of $10^{-6}$ Torr to 10 Torr.

5. The method of claim 1, wherein at least a portion of the subset of the ions transmitted along the second direction interact with one or more gases at a pressure selected over the range of 0.01 Torr to 1000 Torr in the inlet or ion injection pathway and undergo dissociation.

6. The method of claim 1, wherein at least a portion of the subset of the ions transmitted along the second direction interact with the one or more gases at a pressure greater than 0.01 Torr in the ion injection pathway or inlet and undergo beam-type collision activated dissociation.

7. The method of claim 1, wherein at least a portion of the subset of the ions transmitted along the second direction interact with reagent ions in the ion injection pathway or inlet and undergo ion reaction dissociation to generate the product ions.

8. The method of claim 1, wherein at least a portion of the subset of the ions transmitted along the second direction interact with electrons in the ion injection pathway or inlet and undergo electron reaction dissociation to generate the product ions.

9. The method of claim 1, wherein at least a portion of the subset of the ions transmitted along the second direction interact with reagent molecules in the ion injection pathway or inlet and undergo neutral reaction dissociation to generate the product ions.

10. The method of claim 1, wherein at least a portion of the subset of the ions transmitted along the second direction interact with electromagnetic radiation from a laser source in the ion injection pathway or inlet and undergo laser-induced dissociation to generate the product ions.

11. The method of claim 1, wherein the second direction is opposite to the first direction.

12. The method of claim 1, wherein a portion of the subset of the ions transmitted along the second direction is provided in the inlet for a residence time greater than or equal to 1 millisecond.

13. The method of claim 1, wherein a portion of the subset of the ions transmitted along the second direction is provided in the inlet for a residence time selected from the range of 1 millisecond to 100 milliseconds.

14. The method of claim 1, wherein the method is implemented in a tandem mass spectrometer instrument or a multistage mass spectrometer instrument not having a separate collision cell.

15. The method of claim 1, wherein the inlet is an atmospheric pressure inlet in fluid communication with the ion source.

16. The method of claim 1, wherein the ion injection pathway is housed within one or more differentially pumped chambers, wherein the pressure decreases from a value of 1 Torr to 1000 Torr at the inlet to a value of $10^{-10}$ Torr to 0.1 Torr at the ion selection device.

17. The method of claim 1, wherein the ion injection pathway ion optics comprise a first multipole RF device and a second multipole RF device provided between the inlet and the ion selection device and in fluid communication with each other; wherein the first multipole RF device is proximate to the inlet and the second multipole RF device is proximate to the ion selection device; wherein the step of transmitting the subset of the ions having the preselected range of mass-to-charge ratios along the second direction comprises re-injecting the subset of the ions into the first and second multipole RF devices.

18. The method of claim 1, wherein the ion injection pathway ion optics further comprise one or more ion lenses provided between a multipole RF device and the inlet; or provided between a multipole RF device and the ion selection device; or provided between adjacent multipole RF devices.

19. A method for analyzing a sample using mass spectrometry, the method comprising:

generating ions from the sample using an ion source;

transmitting the ions from the ion source through an inlet into an ion injection pathway having ion injection pathway ion optics;

transmitting the ions along a first direction away from the inlet through the ion injection pathway into an ion selection device having ion selection device ion optics, wherein the ion injection pathway ion optics comprise two or more multipole RF devices and one or more ion lens devices, wherein the multipole RF devices and the ion lens devices are provided between the inlet and the ion selection device and wherein at least one ion lens device is provided between adjacent multipole RF devices;

selecting a subset of the ions in the ion selection device; wherein the subset of the ions have a preselected range of mass-to-charge ratios; and transmitting the subset of the ions having the preselected range of mass-to-charge ratios along a second direction toward the inlet through the ion injection pathway;

re-injecting a portion of the subset of the ions transmitted along the second direction into the inlet or into one of the two or more multipole RF devices provided between the inlet and the ion selection device, wherein one or more of the transmitting selecting steps are repeated one or more times;

wherein the ion injection pathway ion optics have an RF voltage component and a DC voltage component which are under independent control with respect to the ion selection device ion optics;

wherein at least a portion of the subset of the ions transmitted along the second direction interact with one or more gases at a pressure greater than 0.01 Torr in the inlet or ion injection pathway and undergo dissociation, thereby fragmenting at least a portion of the subset of the ions having the preselected range of mass-to-charge ratios to generate product ions; and analyzing the product ions using the ion selection device or a secondary mass analyzer, thereby analyzing the sample using mass spectrometry.

20. A mass spectrometer device for analyzing a sample, the device comprising:

an ion source for generating ions from the sample;

one or more chambers having an inlet for receiving the ions and having ion injection pathway ion optics for transmitting the ions along an ion injection pathway between the inlet and an ion selection device, wherein the ion injection pathway ion optics comprise two or more multipole RF devices and one or more ion lens devices, wherein the multipole RF devices and the ion lens devices are provided between the inlet and the ion selection device and wherein at least one ion lens device is provided between adjacent multipole RF devices;

the ion selection device having ion selection device ion optics, the ion selection device in fluid communication with the one or more chambers for receiving the ions and selecting a subset of the ions having a preselected range of mass-to-charge ratios; and a controller operably connected to the ion optics of the one or more chambers; wherein the controller controls the ion optics so as:

to transmit the ions along a first direction away from the inlet through the ion injection pathway into the ion selection device;

to transmit the subset of the ions having the preselected range of mass-to-charge ratios along a second direction toward the inlet through the ion injection pathway; and to re-inject a portion of the subset of the ions transmitted along the second direction into the inlet or into one of the two or more multipole RF devices provided between the inlet and the ion selection device;

wherein the ion injection pathway ion optics have an RF voltage component and a DC voltage component which are under independent control with respect to the ion selection device ion optics;

wherein at least a portion of the subset of the ions transmitted along the second direction interact with one or more gases at a pressure greater than 0.01 Torr in the inlet or ion injection pathway and undergo dissociation, thereby fragmenting at least a portion of the subset of the ions having the preselected range of mass-to-charge ratios to generate the product ions.

* * * * *